US007489290B2

(12) United States Patent
Shin

(10) Patent No.: US 7,489,290 B2
(45) **Date of Patent: *Feb. 10, 2009**

(54) LIGHT EMITTING DISPLAY DEVICE AND DRIVING METHOD THEREOF

(75) Inventor: Dong-Yong Shin, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 613 days.

This patent is subject to a terminal disclaimer.

(21) Appl. No.: 10/996,571

(22) Filed: Nov. 22, 2004

(65) Prior Publication Data

US 2005/0110726 A1 May 26, 2005

(30) Foreign Application Priority Data

Nov. 26, 2003 (KR) ..... 10-2003-0084483

(51) Int. Cl.
*G09G 3/30* (2006.01)

(52) U.S. Cl. ..... 345/76; 345/92

(58) Field of Classification Search ..... 345/76–86, 345/211–214, 87–100; 315/169.1, 169.4, 315/169.2, 169.3; 313/281, 581, 582, 584
See application file for complete search history.

(56) References Cited

U.S. PATENT DOCUMENTS 6,836,269 B2 12/2004 Maeda et al.
6,989,826 B2 1/2006 Kasai
7,057,589 B2 * 6/2006 Shin et al. ..... 345/82
7,106,281 B2 * 9/2006 Kim et al. ..... 345/76
2003/0038760 A1 * 2/2003 Kim et al. ..... 345/76
2004/0217925 A1 * 11/2004 Chung et al. ..... 345/76
2007/0146251 A1 6/2007 Tsuge et al.

FOREIGN PATENT DOCUMENTS

| | | | |
|---|---|---|---|
| CN | 1402212 | A | 3/2003 |
| CN | 1427385 | A | 7/2003 |
| CN | 1447302 | A | 10/2003 |
| EP | 1 347 436 | A2 | 9/2003 |
| EP | 1 450 343 | A1 | 8/2004 |
| JP | 2004-29803 | | 1/1994 |
| JP | 2003-50564 | | 2/2003 |

(Continued)

OTHER PUBLICATIONS

Patent Abstracts of Japan, Publication No. 2003-323152, dated Nov. 14, 2003, in the name of Hiroshi Takahara et al.

(Continued)

*Primary Examiner*—Nitin Patel
(74) *Attorney, Agent, or Firm*—Christie, Parker & Hale, LLP

(57) ABSTRACT

A light emitting display device includes a data line, first and second signal lines, a pixel circuit, and a data driver for supplying a precharge current to the data line according to a first control signal and supplying a data current to the data line according to a second control signal. The data line can be precharged by driving at least one pixel circuit adjacent to a reference pixel circuit in addition to the reference pixel circuit to which the data current will be supplied when the precharge current is supplied to the data line.

20 Claims, 17 Drawing Sheets

FOREIGN PATENT DOCUMENTS

| | | | |
|---|---|---|---|
| JP | 2003-76327 | | 3/2003 |
| JP | 2003-114645 | | 4/2003 |
| JP | 2003-157049 | | 5/2003 |
| JP | 2003-323152 | | 11/2003 |
| JP | 2004-361935 | | 12/2004 |
| JP | 2005-49430 | | 2/2005 |
| JP | 2005-157319 | | 6/2005 |
| KR | 2003-0013273 | | 2/2003 |
| WO | WO 03/023752 | A1 | 3/2003 |
| WO | WO 03/091980 | A1 | 11/2003 |

OTHER PUBLICATIONS

Patent Abstracts of Japan, Publication No. 2003-050564, dated Feb. 21, 2003, in the name of Shin Asano.

Patent Abstracts of Japan, Publication No. 2003-076327, dated Mar. 14, 2003, in the name of Koichi Iguchi.

Patent Abstracts of Japan, Publication No. 2003-114645, dated Apr. 18, 2003, in the name of Toshiyuki Kasai.

Patent Abstracts of Japan, Publication No. 2003-157049, dated May 30, 2003, in the name of Takeshi Okuno et al.

Patent Abstracts of Japan, Publication No. 2004-029803, dated Jan. 29, 2004, in the name of Dong-Yong Shin.

Patent Abstracts of Japan, Publication No. 2004-361935, dated Dec. 12, 2004, in the name of Hajime Kimura.

Patent Abstracts of Japan, Publication No. 2005-049430, dated Feb. 24, 2005, in the name of Hajime Akimoto et al.

Patent Abstracts of Japan, Publication No. 2005-157319, dated Jun. 16, 2005, in the name of Dong-Yong Shin.

Korean Patent Abstracts, Publication No. 1020030013273 A, dated Feb. 14, 2003, in the name of Toshiyuki Kasai.

* cited by examiner

LIGHT EMITTING DISPLAY DEVICE AND DRIVING METHOD THEREOF

CROSS REFERENCE TO RELATED APPLICATION

This application claims priority to and the benefit of Korea Patent Application No. 10-2003-0084483 filed on Nov. 26, 2003 in the Korean Intellectual Property Office, the entire content of which is incorporated herein by reference.

BACKGROUND OF THE INVENTION (a) Field of the Invention

The present invention relates to a light emitting display device and a driving method thereof. More specifically, the present invention relates to a light emitting display device using organic electroluminescence (EL) and a driving method thereof.

(b) Description of the Related Art

In general, an organic EL display electrically excites a phosphorous organic compound to emit light, and it voltage- or current-drives N×M organic emitting cells to display images. As shown in FIG. 1, the organic emitting cell includes an anode (an ITO anode or an indium tin oxide anode), an organic thin film, and a cathode layer (metal). The organic thin film has a multi-layer structure including an emitting layer (EML), an electron transport layer (ETL), and a hole transport layer (HTL) for maintaining balance between electrons and holes and improving emitting efficiencies. Further, the organic thin film includes an electron injecting layer (EIL) and a hole injecting layer (HIL).

Methods for driving the organic emission cells are classified as a passive matrix method, and an active matrix method using thin film transistors (TFTs). The passive matrix method provides anodes and cathodes that cross (or cross over) each other, and selects a line to drive the organic emission cells. The active matrix method provides TFTs that access respective ITO pixel electrodes, and drives a line according to a voltage maintained by a capacitance of a capacitor accessed to a gate of a TFT. Further, depending on formats of signals applied to the capacitor for establishing the voltage, the active matrix method can be categorized as a voltage programming method and a current programming method.

The pixel circuit of the conventional voltage programming method has difficulties in obtaining high gray scales because of deviations of the threshold voltage ($V_{TH}$) and the carrier mobility, the deviations being caused by non-uniformity of a manufacturing process. For example, in order to represent 8-bit (i.e., 256) gray scales in the case of driving thin film transistors by a voltage of 3V (volts), it is required to apply the voltage to the gate of the thin film transistor with an interval less than a voltage of 12 mV (=3V/256), and if the deviation of the threshold voltage of the thin film transistor caused by the non-uniformity of the manufacturing process is 100 mV, it is difficult to represent high gray scales.

The pixel circuit of the current programming method achieves uniform display characteristics when the driving transistor in each pixel has non-uniform voltage-current characteristics, providing that a current source for supplying the current to the pixel circuit is uniform throughout the whole panel.

However, the pixel circuit of the current programming method produces a long data programming time because of a parasitic capacitance component provided on the data line. In particular, the time (the data programming time) for programming the data on the current pixel line is influenced by a voltage state of the data line according to the data of a previous pixel line, and in particular, the data programming time is further lengthened when the data line is charged with a voltage which has a large difference from the target voltage (the voltage corresponding to the current data). This phenomenon becomes greater as the gray level becomes lower (near black). FIG. 1 shows a graph on variations of data programming times versus gray levels to be written in the conventional light emitting display device. The time t1 to t7 in FIG. 1 represents the data programming times, and the gray lines (e.g., gray 00 through gray 63) on the right of the graph indicate gray levels of the data programmed to the pixel circuit coupled to the previous pixel line.

For example, when the gray level of the data programmed to the pixel circuit coupled to the previous pixel line is "8" and the gray level of the data to be programmed to the pixel circuit coupled to the current pixel line is 8 (i.e., a point where a curve meets the horizontal axis), the time needed for data programming is almost "0" since there is no difference between the voltage state of the data line and the target voltage.

By contrast, the time needed for data programming increases as the difference between the voltage state of the data line and the target voltage increases because the gray level of the data to be currently programmed becomes farther away from the gray level of 8.

Also, the time needed for data programming is inversely proportional to the magnitude of the data current for driving the data line. As such, when the gray level is to be lowered, the data current for driving the data line is reduced, and hence, the data programming time is increased. That is, as can be derived from FIG. 1, when the gray level is lowered (e.g., to near the black level), the data voltage is changed to have a large voltage range with a low driving current, and the data programming time is increased.

SUMMARY OF THE INVENTION

It is an aspect of the present invention to reduce a data programming time in a light emitting display device based on a current driving method.

In accordance with another aspect of the present invention, a light emitting device with accurate data representation is provided.

In an exemplary embodiment of the present invention, a light emitting display device is provided. The light emitting display device includes: a data line formed in one direction and for transmitting a data current; a first signal line and a second signal line for transmitting a first scan signal and a second scan signal respectively, the first signal line and second signal line crossing the data line and a plurality of other data lines; a plurality of pixel circuits formed at areas generated by crossing the first and second signal lines with the data line and the plurality of other data lines and for displaying images which correspond to the data current; and a data driver for supplying a precharge current to the data line according to a first control signal and for supplying the data current to the data line according to a second control signal.

The data current may be supplied to a reference pixel circuit of the pixel circuits; a first pixel circuit near the reference pixel circuit may be driven in addition to the reference pixel circuit to which the data current will be supplied; and the data line may be precharged by the first pixel circuit and the reference pixel circuit when the precharge current is supplied.

The reference pixel circuit and the first pixel cirucit, which may be adjacent to a first direction of the reference pixel circuit and consecutively arranged with the reference pixel circuit, may be driven when the precharge current is supplied.

The reference pixel circuit and a second pixel circuit, which may be adjacent to a second direction of the reference pixel circuit and consecutively arranged with the reference pixel circuit, may be driven when the precharge current is supplied.

The first direction and the second direction may be opposite directions.

The precharge current may be X times the data current and X pixel circuits of the pixel circuits including the reference pixel may be driven to charge the precharge current in the data line when the precharge current is supplied.

When the precharge current is X times the data current, a time for supplying the precharge current may satisfy the condition: $T \geqq t/X$ where T is the time for supplying the precharge current, and t is a time for programming a data on the reference pixel.

At least one of the circuits may include: a first switch for applying the data current provided from the data line in response to the first scan signal provided from the first signal line; a capacitor for charging a voltage corresponding to the data current provided from the first switch; a light emitting element; a first transistor for supplying a current corresponding to the voltage charged in the capacitor to the light emitting element; and a second switch for interrupting the current supplied from the first transistor to the light emitting element in response to the second scan signal provided from the second signal line.

At least one of the pixel circuits may include: a first transistor for forming a path for applying a current supplied through the data line; a second transistor, operable by the first scan signal, for controlling the current flow between the data line and the first transistor; a capacitor for converting the current flowing through the path formed by the first transistor into a voltage; a third transistor, operable by the second scan signal, for performing a switching operation between the first transistor and the capacitor; a fourth transistor for forming a current mirror together with the first transistor and for supplying a current corresponding to the voltage at the capacitor; and a light emitting element for emitting light according to the magnitude of the current supplied by the fourth transistor and for performing a display operation.

At least one of the pixel circuits may include: a pixel unit for displaying images corresponding to the data current; and a precharger for charging a current supplied from the data driver in the data line into the precharge current.

In another exemplary embodiment of the present invention, a light emitting display device is provided. The light emitting display device includes: a data line, formed in one direction, and for applying a data current; a first signal line and a second signal line for transmitting a first scan signal and a second scan signal respectively, the first signal line and the second signal line crossing the data line; a plurality of pixel circuits including a pixel unit formed at areas generated by crossing the first and second signal lines with the data line and for displaying images which correspond to the applied data current and a precharger for charging a current supplied from the data driver in the data line into a precharge current; and a data driver for supplying the precharge current to the data line according to a first control signal and for supplying the data current to the data line according to a second control signal. The data current is to be supplied to a reference pixel circuit of the plurality of pixel circuits and the data line is precharged by driving a set of the pluality of pixel circuits adjacent to the reference pixel circuit of the plurality of pixel circuits in addition to the reference pixel circuit when the precharge current is supplied to the data line.

The precharger may include: a first switch for interrupting the precharge current provided from the data line in response to a precharge control signal; and a first transistor for supplying the current corresponding to the precharge current to the data line.

In still another exemplary embodiment of the present invention, a method is provided. The method is for driving a light emitting display device having pixel circuits arranged in a matrix format and formed at areas generated by crossing a data line and first and second signal lines in which at least one of the pixel circuits includes a capacitor, a transistor for supplying the current corresponding to a voltage charged in the capacitor, and a light emitting element. The method includes: (a) supplying a precharge current which is X times a data current to the data line to precharge the data line; (b) charging a voltage which corresponds to the data current transmitted from the data line in the capacitor according to a first scan signal provided from the first signal line; and (c) allowing the light emitting element to emit light in response to the current which corresponds to the voltage charged in the capacitor applied from the transistor in response to a second scan signal applied through the second signal line, in which (a) includes driving a reference pixel circuit of the plurality of pixel circuits of a row to which the data current will be provided and a set of the plurality of pixel circuits adjacent to the reference pixel circuit and precharging the data line.

The step (a) may further include driving the reference pixel circuit and a first pixel circuit of the pixel circuits adjacent to a first direction of the reference pixel circuit and consecutively arranged with the reference pixel circuit and precharging the data line.

The step (a) may further include driving the reference pixel circuit and a second pixel circuit of the pixel circuits adjacent to a second direction of the reference pixel circuit and consecutively arranged with the reference pixel circuit and precharging the data line.

The first direction and the second direction may be opposite directions.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
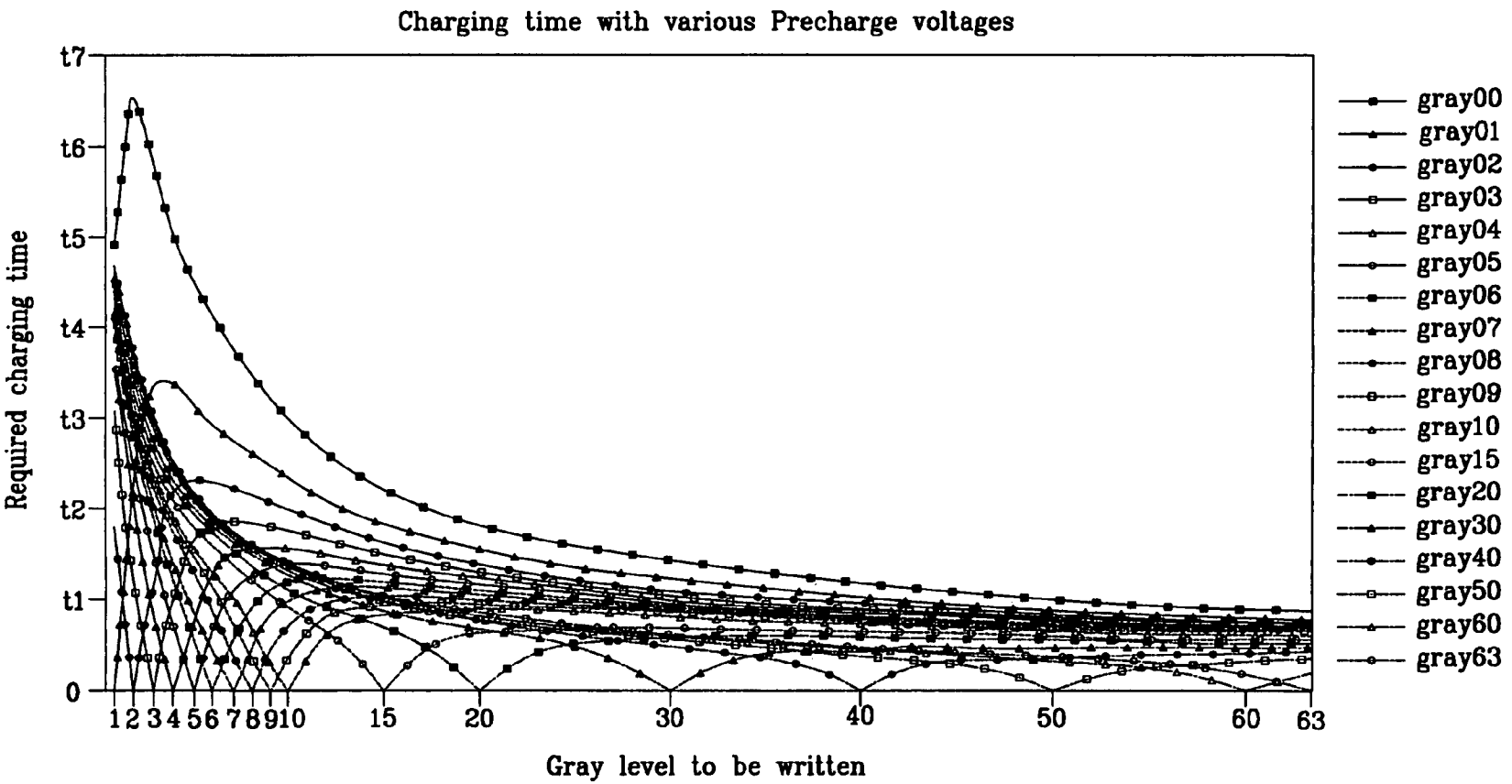
FIG. 1 (Prior Art)
FIG. 1 shows a graph for representing variations of data programming times per gray in a conventional display device.

In the following detailed description, only certain exemplary embodiments of the present invention are shown and described, simply by way of illustration. As those skilled in the art would realize, the described embodiments may be modified in various different ways, all without departing from the spirit or scope of the present invention. Accordingly, the drawings and description are to be regarded as illustrative in nature, and not restrictive.

In the context of the present application, to couple one thing to another refers to directly coupling a first thing to a second thing or to couple a first thing to a second thing with a third thing provided therebetween. In addition, to clarify the present invention, certain components which are not described in the specification can be omitted, and like reference numerals indicate like components.

A light emitting display device, a corresponding pixel circuit, and a driving method thereof according to exemplary embodiments of the present invention will be described in detail with reference to drawings. The light emitting display device to be subsequently described includes an organic electroluminescent (EL) display device.

Figure 2:
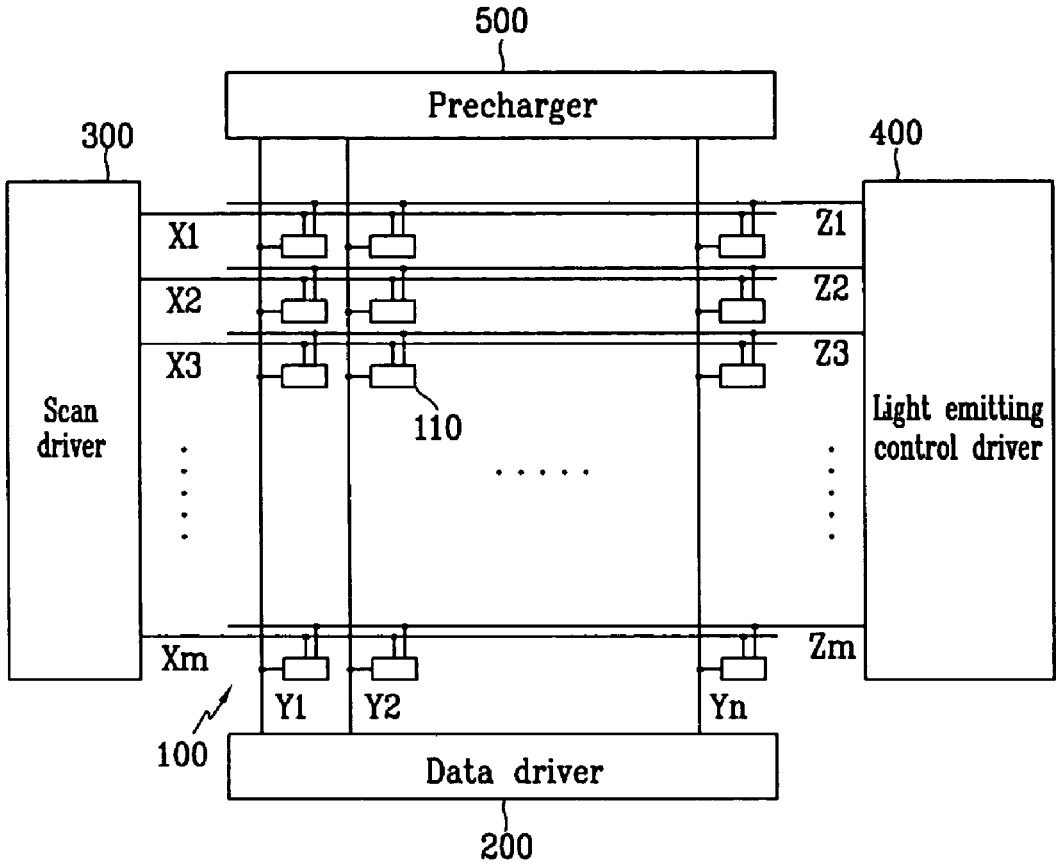
FIG. 2 shows a simplified plan view of a light emitting display device according to a first exemplary embodiment of the present invention.

FIG. 2 shows a simplified plan view of a light emitting display device according to a first exemplary embodiment of the present invention.

As shown in FIG. 2, the light emitting display device includes organic EL display panel (referred to as a display panel hereinafter) 100, data driver 200, scan driver 300, light emitting control driver 400, and precharger 500.

Display panel 100 includes data lines Y1 to Yn arranged in a column direction, and signal lines X1 to Xm and Z1 to Zm arranged in a row direction, and pixel circuits 110.

The signal lines include first signal lines X1 to Xm for transmitting first scan signals, and second signal lines Z1 to Zm for transmitting second scan signals for controlling an emit (or emission) period of an organic EL element (or OLED). In addition, the signal line can include signal lines for transmitting control signals for performing a precharge. Pixel circuits 110 are formed at pixel areas defined by data lines Y1 to Yn and first and second signal lines X1 to Xm and Z1 to Zm.

Data driver 200 precharges the data lines Y1 to Yn at a specific current level, and applies a data current ($I_{data}$) to the data lines Y1 to Yn. In particular, data driver 200 includes a first current source for generating the data current ($I_{data}$) and a second current source for generating an added current ($(X-1)I_{data}$) for generating the precharge current. Data driver 200 couples data lines Y1 to Yn to the first and second current sources so that the precharge current ($XI_{data}$) may flow to the data lines according to an operation by precharger 500 in a precharge operation of the pixel to be described below, and data driver 200 couples data lines Y1 to Yn to the first current source so that the current ($I_{data}$) may flow to the data lines in a data programming operation. The data current and the added current can be generated by a current mirror circuit, known to those skilled in the art. Data driver 200 supplies the precharge current ($XI_{data}$) to the data lines as described above according to a first control signal applied by an external controller (not shown), and supplies the data current ($I_{data}$) to the data lines according to a second control signal.

Scan driver 300 sequentially applies first scan signals to first signal lines X1 to Xm to select pixel circuits 110. Emit control driver 400 sequentially applies second scan signals to second signal lines Z1 to Zm to control light emission of the pixel circuits 110.

Precharger 500 is driven by the applied control signals to allow the precharge current ($XI_{data}$) to flow to the data lines.

Scan driver 300, light emitting control driver 400, and/or data driver 200, and/or precharge driver 500 can be coupled to the display panel 100, or can be installed as a chip in a tape carrier package (TCP) attached and coupled to display panel 100. They can also be installed as a chip on a flexible printed circuit (FPC) or a film attached and coupled to display panel 100, which can be referred to as a chip on flexible board, chip of film (COF) method. In addition, they can be directly installed on a glass substrate of the display panel, which can be referred to as a chip on glass (COG) method, or can also be substituted with a driving circuit on the same layer as that of signal lines, data lines, and thin film transistors (TFTs).

Figure 3:
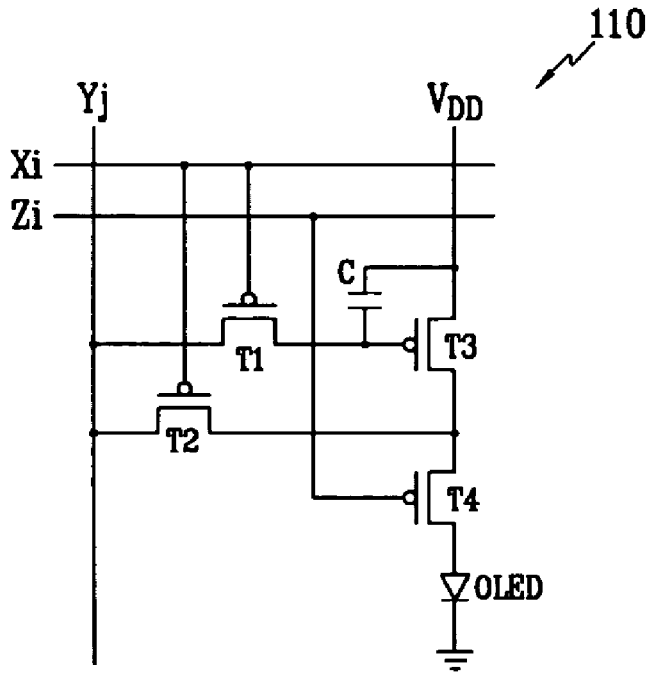
FIG. 3 shows a simplified circuit diagram of a pixel circuit of a light emitting display device according to the first exemplary embodiment of the present invention.

FIG. 3 shows a circuit diagram of pixel circuit 110 according to the first exemplary embodiment of the present invention. For ease of description, FIG. 3 illustrates the pixel circuit 110 coupled to the jth data line Yj and the ith signal lines Xi and Zi.

As shown, pixel circuit 110 includes organic EL element OLED, transistors T1, T2, T3, T4, and capacitor C. Transistors T1, T2, T3, T4 include PMOS transistors. The transistors can be TFTs which respectively have a gate electrode, a drain electrode, and a source electrode formed on the glass substrate of display panel 100 as a control electrode and two main electrodes. However, the transistor types of the present invention are not restricted to PMOS transistors and/or TFTs. Instead, the transistors can be realized by any suitable active elements each of which includes a first electrode, a second electrode, and a third electrode, respectively, and controls the current flowing to the third electrode from the second electrode according to a voltage applied between the first and second electrodes to the third electrode. Of course, those skilled in the art would recognize that the voltage polarities and levels may be different when other active elements are used.

In more detail, the three electrodes (or terminals) of transistor T1 are respectively coupled to first signal line Xi, data line Yj, and capacitor C, and transistor T1 transmits the data current ($I_{data}$) provided by data line Yj to a gate (or gate electrode) of transistor T3 in response to the first scan signal provided by first signal line Xi. In this instance, the data current ($I_{data}$) is transmitted to the gate of transistor T3 when a current which corresponds to the data current ($I_{data}$) flows to a drain of transistor T3. Capacitor C is coupled between the gate and a source of transistor T3, and is charged with a voltage which corresponds to the data current ($I_{data}$) provided by the data line Yj. The current given in Equation 1 flows to transistor T3 according to the voltage charged in the capacitor C1.

$$I_{OLED} = \frac{\beta}{2}(V_{GS} - V_{TH})^2 = I_{data} \quad \text{Equation 1}$$

where VGS is a voltage between the gate and the source of transistor T3, VTH is a threshold voltage at transistor T3, and β is a constant.

Transistor T4 is coupled between transistor T3 and organic EL element OLED, and couples transistor T3 and organic EL element OLED in response to the low-level second scan signal provided by second signal line Zi. Organic EL element OLED is coupled between transistor T4 and a ground voltage, and emits light corresponding to the current supplied through transistor T4. Transistor T2 transmits the data current ($I_{data}$) applied in response to the low-level first scan signal provided by first signal line Xi to the drain of transistor T3.

Figure 4:
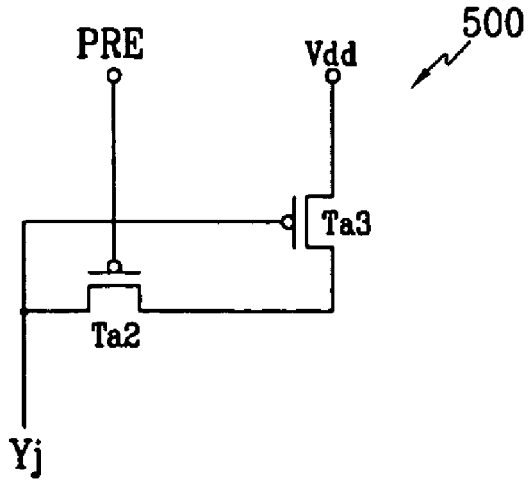
FIG. 4 shows a circuit diagram of a precharger according to the first exemplary embodiment of the present invention.

FIG. 4 shows an equivalent circuit diagram of precharger 500 according to the first exemplary embodiment of the present invention.

As shown, precharger 500 includes transistors Ta3 and Ta2 which include PMOS transistors. In particular, transistor Ta3 has X times the ratio of (a channel width: Width)/(a channel length: Length) of transistor T3 of FIG. 3 for configuring pixel circuit 110 or (X−1) times the ratio of the Width/Length. For ease of description, (the channel width: Width)/(the channel length: Length) will be simplified as "W/L." Transistors Ta3, T3 have the same polarities. That is, when transistor T3 is a PMOS transistor, transistor Ta3 is also a PMOS transistor. In addition, it is desirable for the voltage of voltage source Vdd and the voltage of voltage source $V_{DD}$ respectively applied to the sources of transistors Ta3 and T3 to be the same.

In more detail, a source and a drain of transistor Ta2 are respectively coupled to data line Yj and transistor Ta3, and transistor Ta2 transmits precharge current ($XI_{data}$) provided by data line Yj to the drain of transistor Ta3 in response to the control signal of control signal source PRE applied to the gate of transistor Ta2.

Figure 5A:
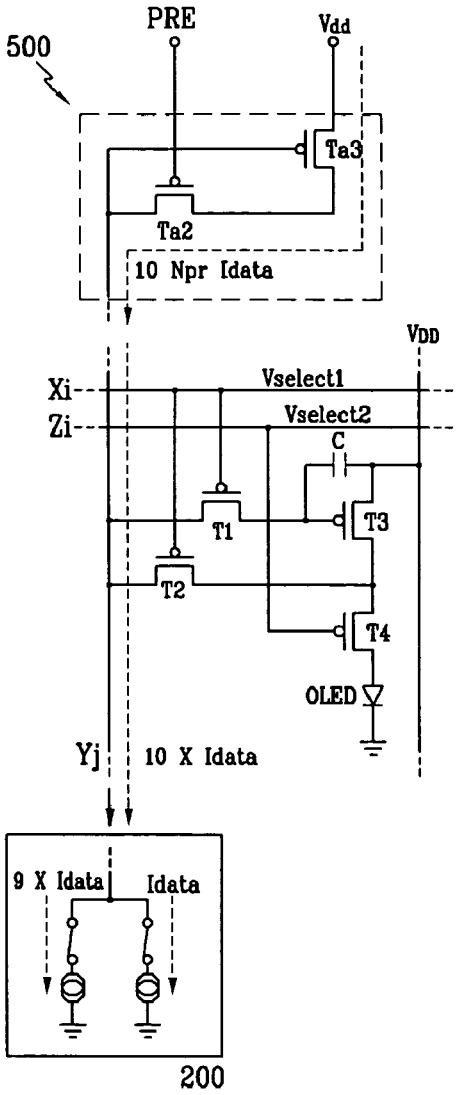
FIGS. 5A and 5B show current supply states according to an operational state of the light emitting display device according to the first exemplary embodiment of the present invention.
Figure 5B:
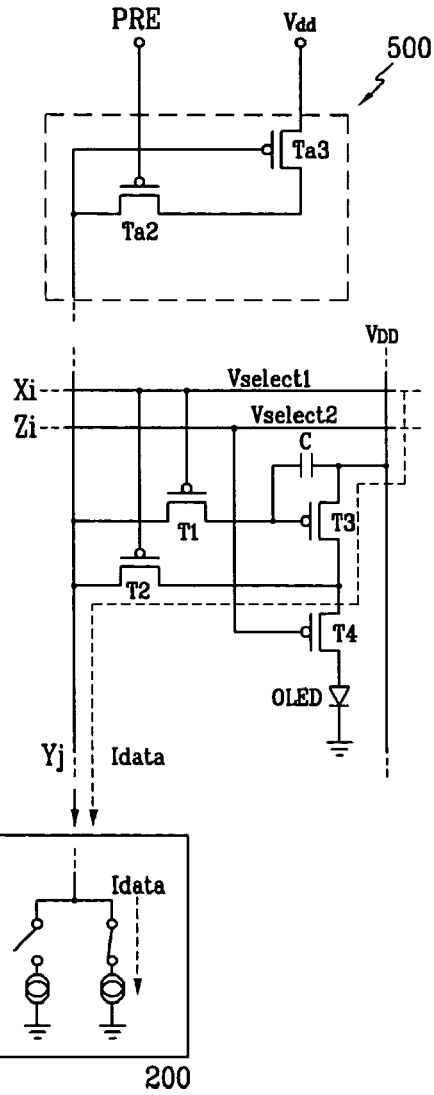
Figure 6:
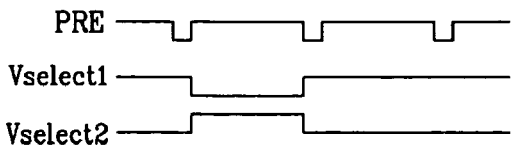
FIG. 6 shows a timing diagram of respective signals according to the first exemplary embodiment of the present invention.

Referring to FIGS. 5A, 5B, and 6, an operation of the light emitting display device according to the first exemplary embodiment of the present invention will be described in detail.

FIGS. 5A and 5B show a current supply state of the light emitting display device according to the first exemplary embodiment of the present invention, FIG. 5A showing a state that the current is supplied in the precharge stage, and FIG. 5B showing a state that the current is supplied in the data programming stage. FIG. 6 shows a timing diagram of respective signals according to the first exemplary embodiment of the present invention.

A precharge operation is executed in order to reduce the data programming time before the data programming operation for supplying the data current to the data line is executed.

As shown in FIGS. 5A and 6, a control signal of control signal source PRE for precharging is applied to transistor Ta2 of precharger 500, and an added current $(X-1)I_{data}$ (or $9XI_{data}$) for generating a precharge current is concurrently generated together with data current $I_{data}$ provided by data driver 200, before a first scan signal is applied to first signal line Xi.

Accordingly, transistor Ta2 of precharger 500 is turned on, transistor Ta3 is diode-connected, and precharge current ($I_{data}+(X-1)I_{data}=XI_{data}$ or $10XI_{data}$) flows through the light emitting display device by following data line Yj.

In this instance, current $XI_{data}$ (or $10XI_{data}$) flowing to transistor Ta3 is expressed in Equation 2 since transistor Ta3 has X times the ratio of W/L of transistor T3 of the pixel circuit 110.

$$XI_{data} = \frac{X\beta}{2}(V_{GS} - V_{TH})^2 \quad \text{Equation 2}$$

where β has a characteristic of $[\mu C_{OX}(W/L)]$.

Therefore, the voltage which substantially corresponds to the current of $I_{data}$ is applied at data line Yj.

When first scan signal Vselect1 is applied to first signal line Xi and data current $I_{data}$ is generated from data driver 200 after the precharge operation, transistor T1 is turned on by first scan signal Vselect1, and the voltage corresponding to data current $I_{data}$ provided by data lines Y1 to Yn (e.g., data line Yj) is charged in capacitor C. Also, transistor T2 is turned on by first scan signal Vselect1, and transistor T3 is diode-connected. Hence, capacitor C is charged with the voltage corresponding to data current $I_{data}$ flowing through transistor T3, and the corresponding voltage is charged in capacitor C until no current flows to transistor T1. In particular, since the precharge voltage (the voltage near a voltage which corresponds to current of $I_{data}$) has been applied to data line Yj according to the previous precharge operation, capacitor C is quickly charged with the voltage corresponding to data current of $I_{data}$.

When the charging process is finished, transistors T1, T2 are turned off, and transistor T4 is turned on according to second scan signal Vselect2 applied from second signal line Zi so that data current $I_{data}$ is supplied to organic EL element OLED through transistor T4 and organic EL element OLED emits light corresponding to the current.

Since the data programming operation is performed after the current precharge operation, the voltage charging process according to the data current is quickly executed and the gray scales are represented more accurately.

When differences of element characteristics of transistor Ta3 of precharger 500 and transistor T3 of pixel circuit 110 become greater, data line Yj may be precharged by a voltage which is far from the final voltage corresponding to data current $I_{data}$ according to the first embodiment. Therefore, the data programming time does not allow the displayed images to be greatly influenced by transistor Ta3, and as a result, vertical stripes can be displayed because of characteristic deviations of transistor Ta3.

Also, a current difference can be generated between the respective pixels on the display panel because of a difference between the voltage level of voltage source Vdd of precharger 500 and the voltage level of voltage source $V_{DD}$ of pixel circuit 110. That is, a voltage drop (IR drop) is generated according to the $V_{DD}$ wiring at each pixel circuit 110, and hence, the voltage level of voltage source $V_{DD}$ of pixel circuit 110 has a specific distribution, and a difference is generated from the voltage level of voltage source $V_{DD}$ of pixel circuit 110. In this instance, the current flowing to pixel circuit 110 is precharged less as the voltage of source $V_{DD}$ at pixel circuit 110 becomes less, and in particular, when the display panel is emitted with full white, the voltage drop is more severely generated, and a corresponding distribution of the voltage level of source $V_{DD}$ may be reflected on a brightness distribution. This problem is further seriously generated as resolution is increased.

Also, even when the element characteristics of transistor Ta3 of precharger 500 and transistor T3 of pixel circuit 110 are the same, and the voltage level of source Vdd of precharger 500 corresponds to the voltage level of source $V_{DD}$ of pixel circuit 110, voltage establishment of precharger 500 and pixel circuit 110 becomes different because of the voltage drop caused by the parasitic resistance on the data lines. That is, the voltage drop is generated according to the data lines even when the current is programmed to the data lines, a gate of transistor T3 is precharged with a voltage which is far from the final voltage (the voltage corresponding to the data current) as pixel circuit 110 becomes (physically) far from precharger 500, the data programming time lacks, and hence, the image quality may be degraded.

Therefore, a method for precharging the pixels in consideration of the above-noted problems will be described in a second exemplary embodiment.

Figure 7:
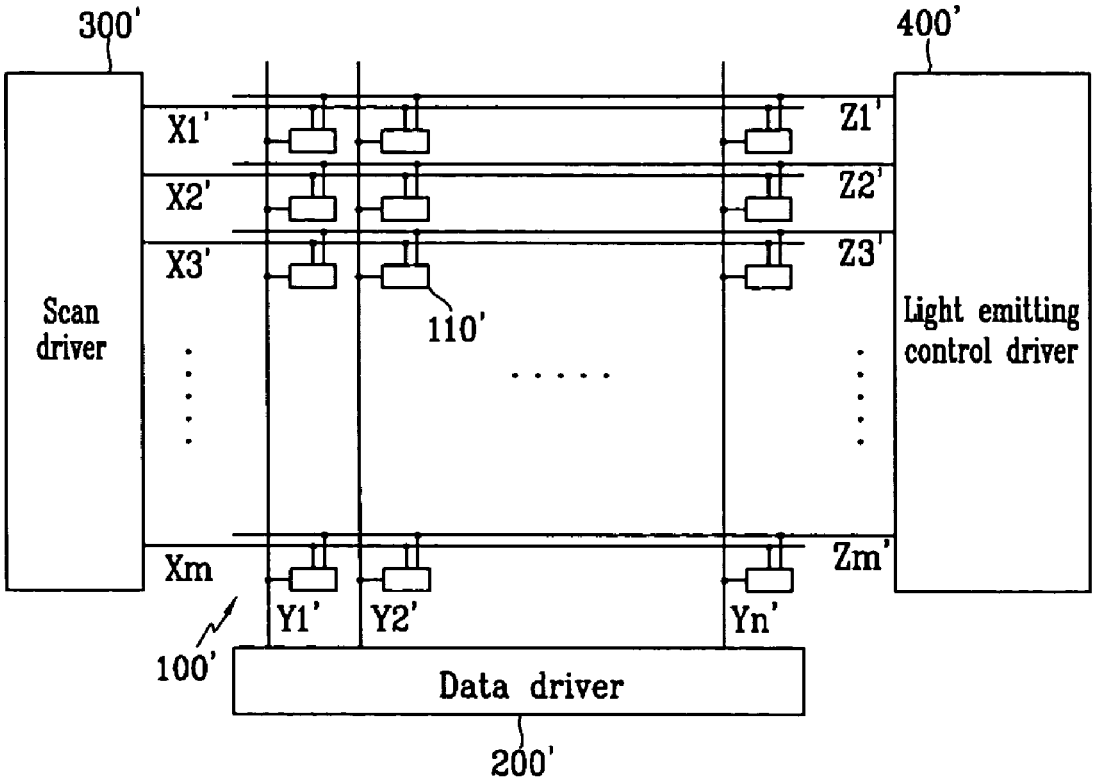
FIG. 7 shows a simplified plan view of a light emitting display device according to a second exemplary embodiment of the present invention.

A light emitting display device and a pixel circuit according to the second exemplary embodiment of the present invention will be described. FIG. 7 shows a simplified plan view of a light emitting display device according to a second exemplary embodiment of the present invention.

As shown, the light emitting display device according to the second exemplary embodiment includes display panel 100', data driver 200', scan driver 300', and light emitting control driver 400', and does not include an additional precharger (e.g., precharger 500 of FIG. 2). Since the configuration and operation of the respective components, and the configuration of the pixel circuit 110' in the second embodiment substantially correspond to those of the first embodiment, no corresponding description will be provided.

An operation of the light emitting display device according to the second exemplary embodiment will be described.

Figure 8:
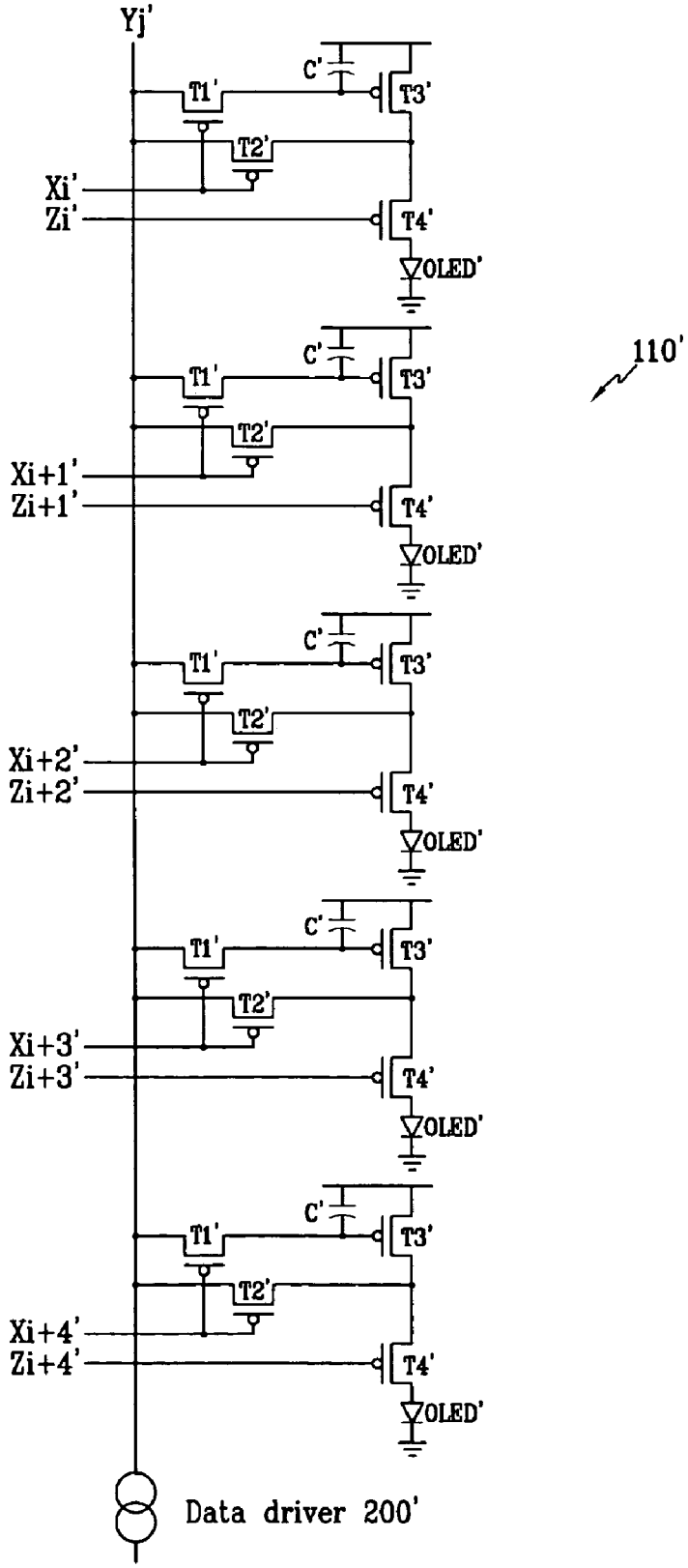
FIG. 8 shows pixels of five consecutive rows coupled to the same data line in the light emitting display device according to the second exemplary embodiment of the present invention.

FIG. 8 shows pixel circuits or pixels 110' of five consecutive rows coupled to same data line Yj' in the light emitting display device according to the second exemplary embodiment of the present invention. That is, FIG. 8 shows the pixel circuits or pixels 110' with five rows formed at the points where the jth data line and ith to (i+4)th first and second signal lines cross with (or cross over) each other.

Instead of precharging the data lines by using the additional precharger as described in the first embodiment, the data lines of the second exemplary embodiment are precharged using the adjacent pixels. In more detail, when precharging pixel(s) on one row (e.g., the ith row), pixel(s) of the (X−1) rows adjacent to the ith row are driven and the precharge current which is X times the data current is supplied to the data lines (e.g., data line Yj') so that the data lines are precharged with the voltage which substantially corresponds to the data current according to driving of the respective pixel(s). After this, the pixel(s) coupled to the ith row are driven and the data current is supplied thereto so that the data may be written on the pixel(s) of the ith row. As such, the second exemplary embodiment can variably establish the number of pixel(s) driven at the precharge operation according to a multiple relation X between the precharge current and the data current. For example, when the precharge current is five times the data current, the data lines are precharged by driving the pixels coupled to the five consecutive rows including the pixel of the row on which the data will be written.

Figure 9:
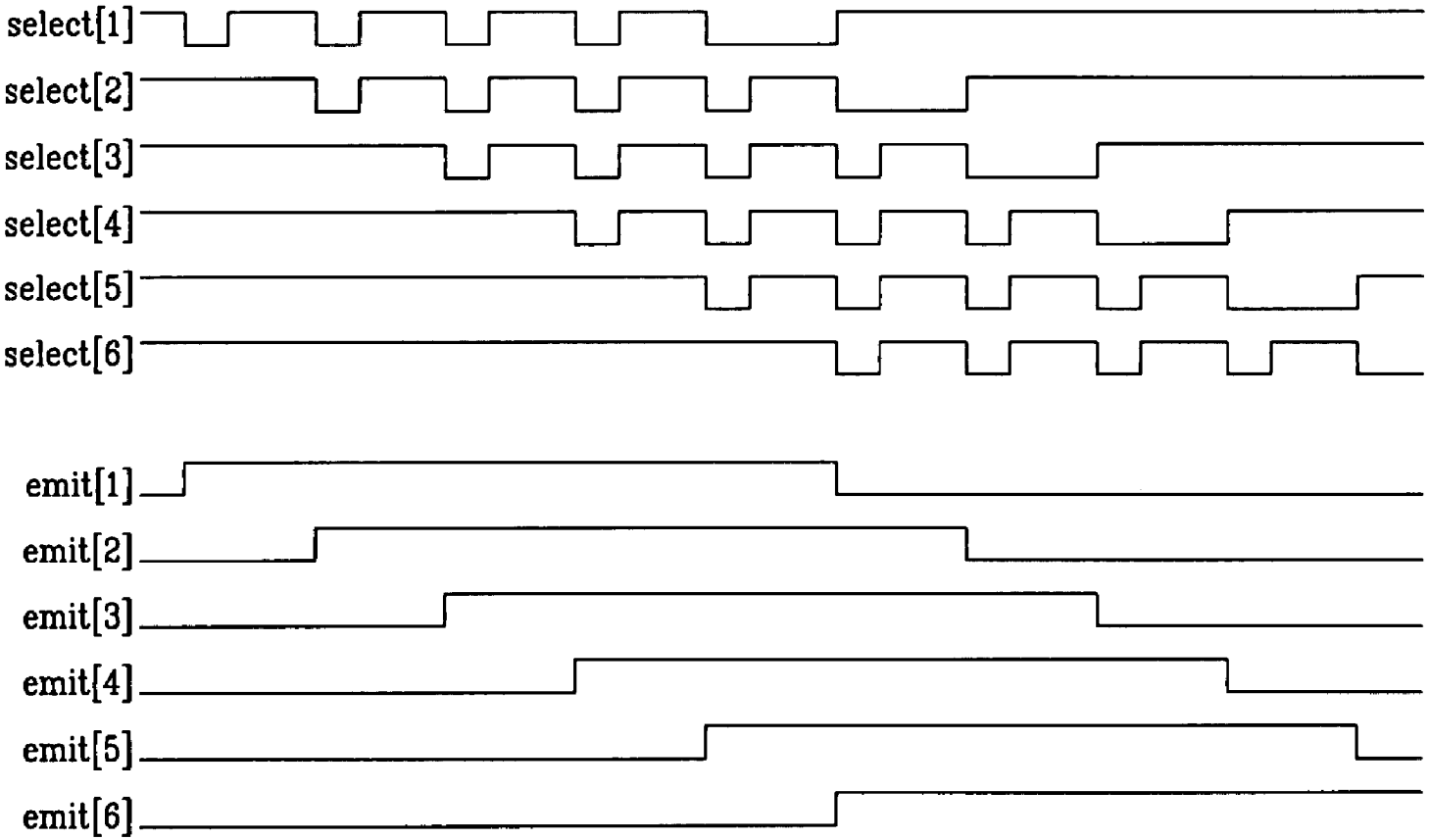
FIG. 9 shows a waveform diagram for driving a pixel circuit shown in FIG. 8.

FIG. 9 shows a waveform diagram for driving the pixel circuits or pixels of FIG. 8. The waveform shown in FIG. 9 concurrently selects the pixels of the consecutive plural rows for a predetermined time to precharge the data lines, and selects the pixels of one row from among the pixels of the plural rows to have timing for writing display information, that is, data to be displayed on a pixel of the corresponding row for a predetermined time.

Figure 10A:
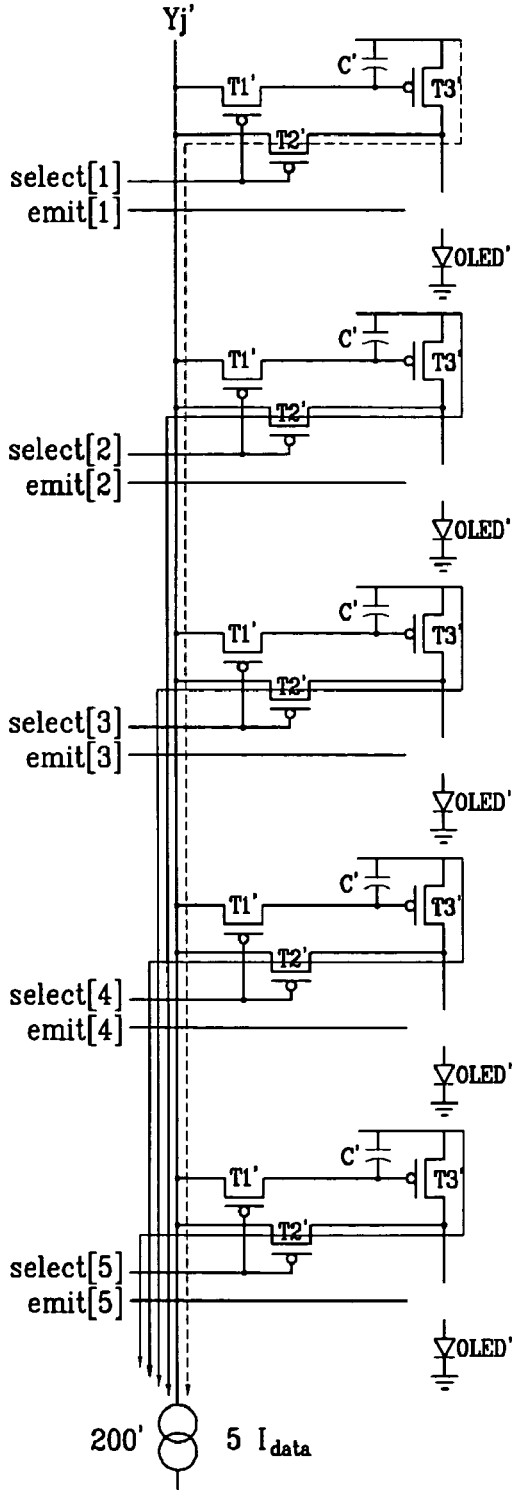
FIGS. 10A and 10B show circuit diagrams for describing an operation of the light emitting display device when the waveform of FIG. 9 is applied.
Figure 10B:
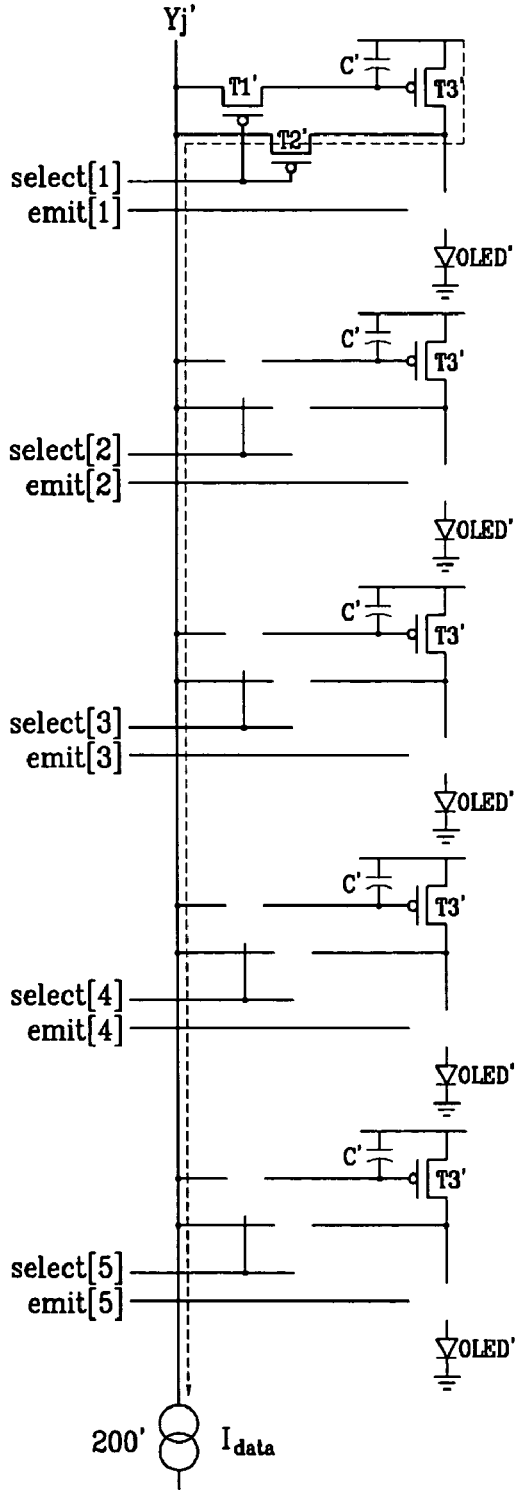

FIGS. 10A and 10B show circuit diagrams for describing an operation of the light emitting display device when the waveform of FIG. 9 is applied.

Referring to FIGS. 10A and 10B, a precharge operation for reducing the data programming time is performed before the data programming operation is performed in a like manner of the first embodiment.

As shown in FIG. 9, when attempting to program the data on the pixel of the ith row, first scan signals select[1], select[2], select[3], select[4], and select[5] are supplied to the pixels of i to i+(X−1)th rows (a total of X rows), and the data lines (e.g., data line Yj') are coupled to the first and second current sources of data driver 200'. In this instance, X is 5, and accordingly, first scan signals select[1], select[2], select[3], select[4] and select[5] are supplied to the ith to (i+4)th rows (first to fifth rows).

Transistors T1' in the pixel circuit of the ith to (i+4)th rows are turned on by first scan signals select[1], select[2], select[3], select[4], and select[5], and transistors T2' are also turned on by first scan signals select[1], select[2], select[3], select[4], and select[5] so that transistors T3' are diode-connected. Accordingly, as shown in FIG. 10A, the precharge current $XI_{data}$ (e.g., $5I_{data}$) flows along data line Yj'.

In this instance, since transistors T3' of the respective pixel circuits provided on the i to i+(X−1)th rows have the identical ratio of W/L, the precharge current supplied from the data line Yj' is given as $(XI_{DATA})/X$, and is supplied to the pixel circuits of the respective rows. As a result, the voltage which corresponds to current of $I_{data}$ is applied to data line Yj'.

In particular, when first scan signal select[1] is maintained to be supplied to the pixel of the ith row and no first scan signal is supplied to the pixels of the residual (i+1) to (i+(X−1))th rows (e.g., when the first scan signal is varied to a high level from a low level) after the precharge operation as shown in FIG. 9, the data programming operation on the pixel circuit of the ith row is executed as shown in FIG. 10B. In this instance, data line Yj' is coupled to the first current source of data driver 200', and data current $I_{data}$ is supplied to data line Yj'.

Accordingly, transistors T1 and T2 of the pixel circuit of the ith row are driven, and data current $I_{data}$ transmitted from data line Yj' is charged in capacitor C' through transistor T1'. Since the precharge voltage (the voltage which is near a voltage corresponding to current $I_{data}$') is currently applied to data line Yj' according to the previous precharge operation, the voltage which corresponds to data current $I_{data}$ is quickly charged in capacitor C'.

When the charging is finished, transistors T1' and T2' are turned off, and when second scan signal emit[1] applied from second signal line Zi' is supplied to the pixel circuit of the ith row, transistor T4' of the corresponding pixel circuit is turned on to supply data current $I_{data}$ to organic EL element OLED' through transistor T4', and organic EL element OLED' emits light in correspondence to current $I_{data}$.

Since the data programming operation is performed after the current precharge operation, the voltage charging according to the data current is swiftly executed, and further accurate gray scales are represented.

In particular in the second embodiment, the problems caused by the element characteristic differences of the transistor of the precharger and the transistor of the pixel circuit, and the difference of the voltage levels of e.g., voltage source Vdd and voltage source $V_{DD}$ of FIGS. 2, 3, 5A, and 5B, are effectively eliminated, and the voltage charging according to the data current is quickly performed by using the pixels to be emitted and the consecutive pixels and precharging the data lines without using an additional precharger.

The precharge method of the second embodiment in a like manner can be applied to light emitting display devices having different configurations of pixel circuits.

Referring to FIGS. 11, 12, 13A and 13B, a light emitting display device according to a third exemplary embodiment of the present invention will be described.

Figure 11:
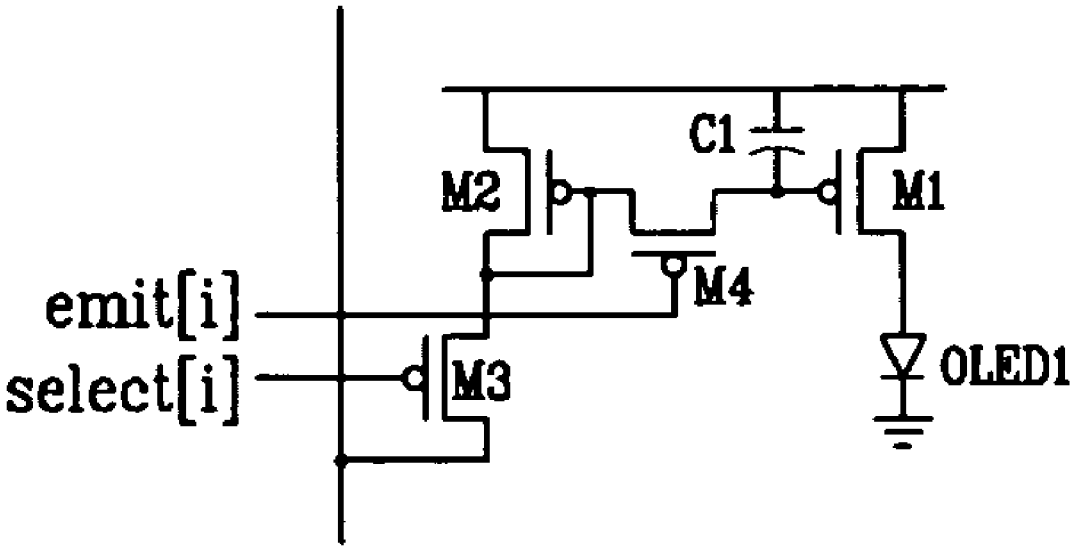
FIG. 11 shows a simplified pixel circuit of a light emitting display device according to a third exemplary embodiment of the present invention.
Figure 12:
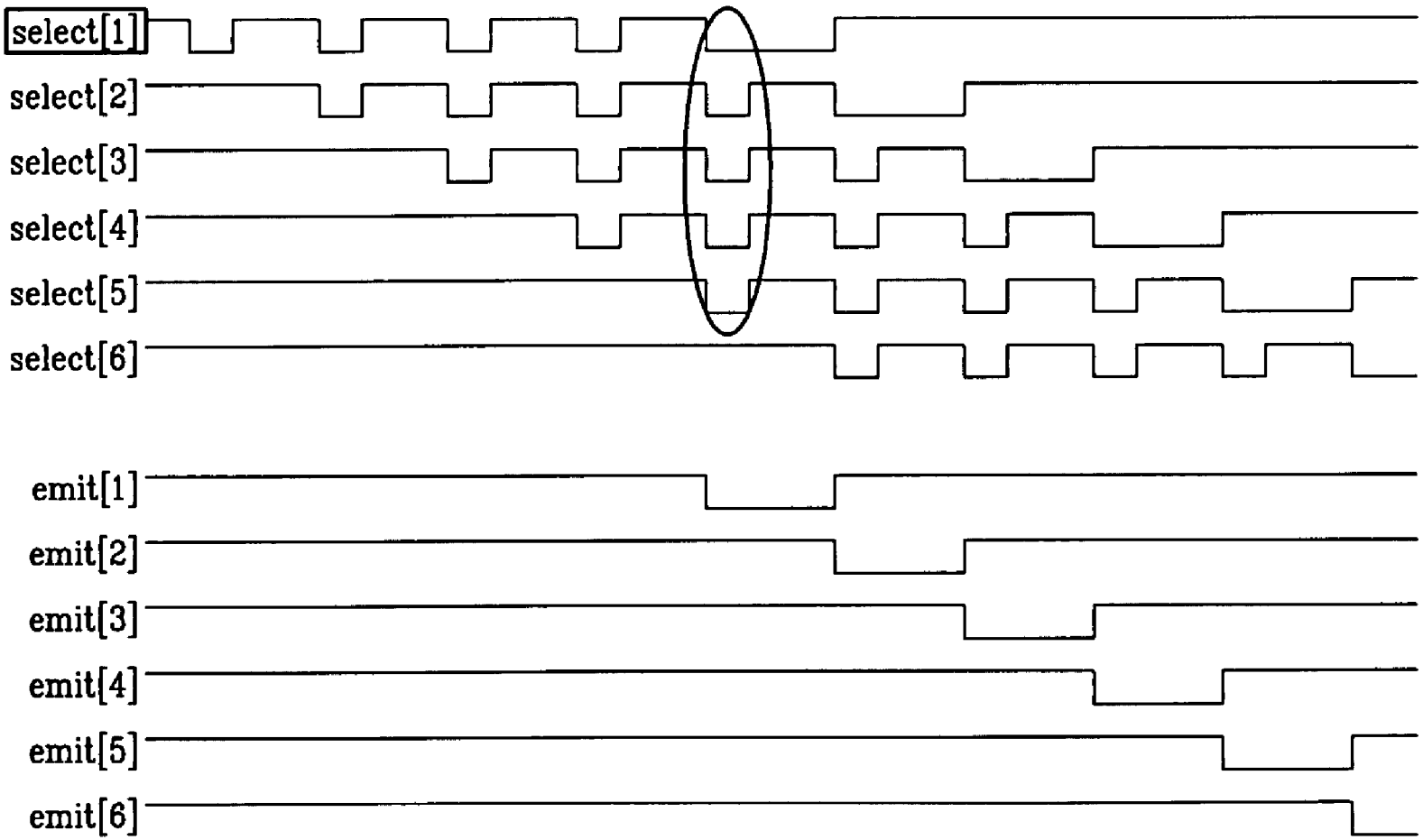
FIG. 12 shows a waveform diagram for driving a pixel circuit shown in FIG. 11.

FIG. 11 shows a pixel circuit diagram of a light emitting display device according to the third exemplary embodiment of the present invention. The pixel circuit shown in FIG. 11 includes transistors M1, M2, M3, M4, capacitor C1, and an organic EL element OLED1. Transistors M1, M2, M3, M4 have reference numerals "M" in order to indicate that the pixel circuit according to the third exemplary embodiment is different from the pixel circuits according to the first and second exemplary embodiments. FIG. 12 shows a waveform diagram for driving the pixel circuit shown in FIG. 11.

Figure 13A:
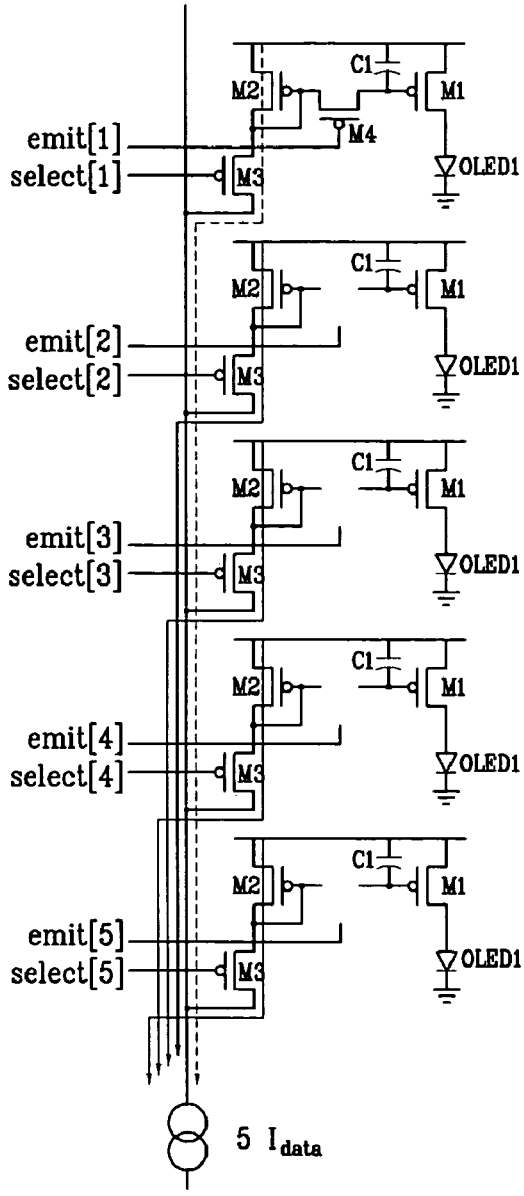
FIGS. 13A and 13B show circuit diagrams for describing an operation of the light emitting display device when the waveform of FIG. 12 is applied.
Figure 13B:
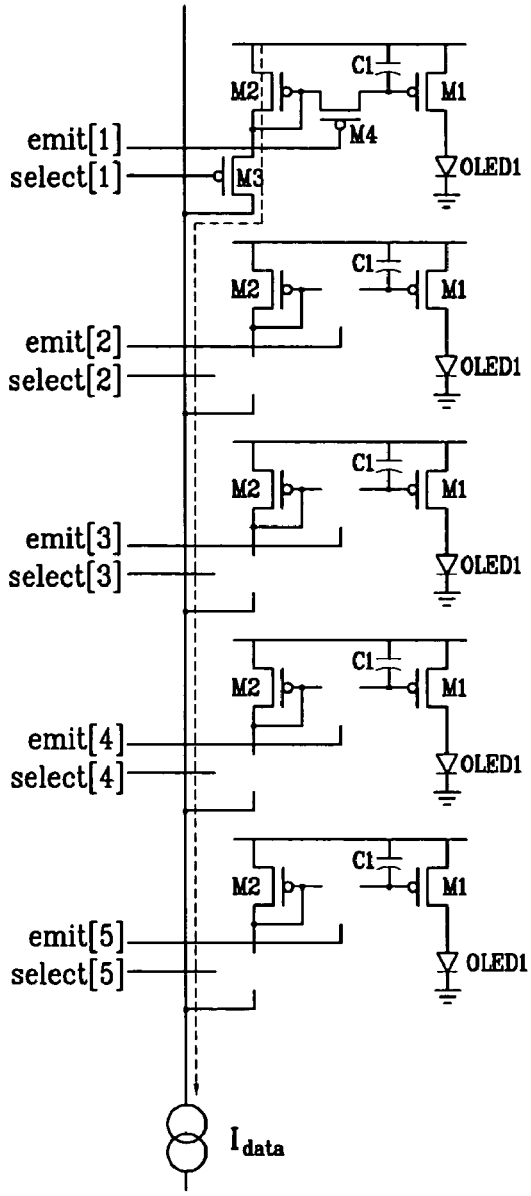

Referring to FIGS. 13A and 13B, an operation of the light emitting display device according to the third exemplary embodiment using the pixel circuits shown in FIG. 11 when the waveform of FIG. 12 is applied will be described. In a like manner of the second exemplary embodiment, consecutive pixels adjacent to the pixels on which the data will be programmed are concurrently driven to precharge the data lines in the precharge operation.

As shown in FIG. 12, when the first scan signals select[1], select[2], select[3], select[4], and select[5] are supplied to the pixels of i to i+(X−1)th rows (a total of X rows), and the precharge current $XI_{data}$ are supplied to the data lines, when attempting to program the data on the pixel of the ith row, transistors M3 of the respective pixels are turned on. In this instance, the transistor M4 of the ith row is turned on, and the transistors M4 of other rows are turned off. At a later time, transistor M4 of the ith row can then be turned off when transistor M4 of the ith+1 row is turned on.

As shown in FIG. 13A, the current flows to the paths on which transistors M2 and M3 of the respective rows are provided. In this instance, since the magnitudes of the respective pixel circuits are the same, the precharge current supplied from the data line becomes $(XI_{data})/X$, and is supplied to the pixel circuits of the respective rows. As a result, the voltage which corresponds to current $I_{data}$ is substantially applied to the data line. In this instance, since the transistor of the ith row is turned on, the gate-source voltage of transistor M2 generated according to current $I_{data}$ is transmitted to capacitor C1, and capacitor C1 of the ith row is precharged with a predetermined voltage.

As shown in FIG. 12, first scan signal select[1] to the ith row is maintained, second scan signal emit[1] is supplied, and data current $I_{data}$ is supplied through the data line after the above-described precharge operation, transistors M3. M4 within the pixel circuit of the ith row are turned on. As shown in FIG. 13B, the current accordingly flows to the path on which transistors M2, M3 of the pixel of the ith row, and a voltage occurs between the gate electrode and the source electrode of transistor M2. The voltage is applied to capacitor C1 through the turned-on transistor M4. In this instance, since the precharge voltage (the voltage which is near a voltage corresponding to current of$I_{data}$) is applied to the data line according to the previous precharge operation, the voltage corresponding to data current $I_{data}$ is quickly transmitted to and charged in capacitor C1. Capacitor C1 applies the transmitted voltage to a gate electrode of transistor M1. Transistor M1 generates a drain current which corresponds to the gate voltage, and organic light emitting diode OLED1 is driven to perform a display operation according to the drain current of transistor M1.

The data programming time can be reduced by increasing the ratio of W/L of driving transistor M1 and mirror transistor M2 in the third embodiment, and since the data programming is possible in the lower current level by precharging the data line as described above, the ratio of W/L can be reduced. Therefore, the area occupied by driving transistor M1 and mirror transistor M2 is decreased to increase the aperture ratio of the light emitting display device, and the data current is reduced to reduce power consumption.

Data can also be programmed by driving not just the pixel of the ith row first but instead can be used to first drive the pixels of other rows after the pixels of the i to i+(X−1)th rows are driven to precharge the data lines in the precharge operation. That is, the pixels of the consecutive rows in other directions with reference to the ith row can be selected and precharged in addition to the method for selecting a plurality of pixels consecutively and sequentially provided on the ith row in order to reduce the data programming time on the pixel of the ith row.

Figure 14:
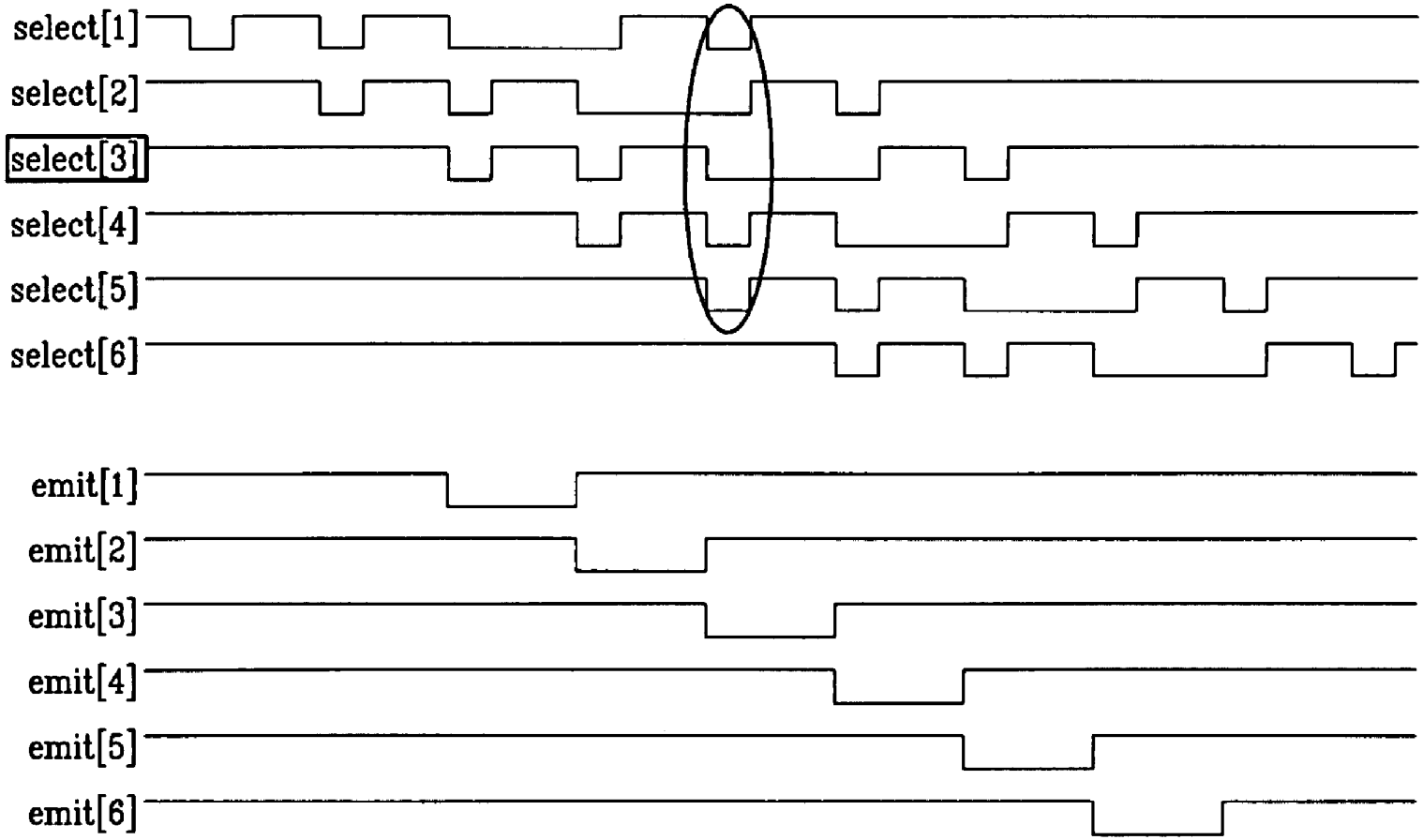
FIG. 14 shows another waveform diagram for driving a pixel circuit shown in FIG. 11.

FIG. 14 shows another waveform diagram for driving the pixel circuit of FIG. 11. The waveform shown in FIG. 14 selects first and second rows and fourth and fifth rows which are adjacent in other directions and consecutively provided with reference to the pixel of the third row and precharge the data lines in the precharge operation in order to program the data on the pixel of the third row.

Figure 15A:
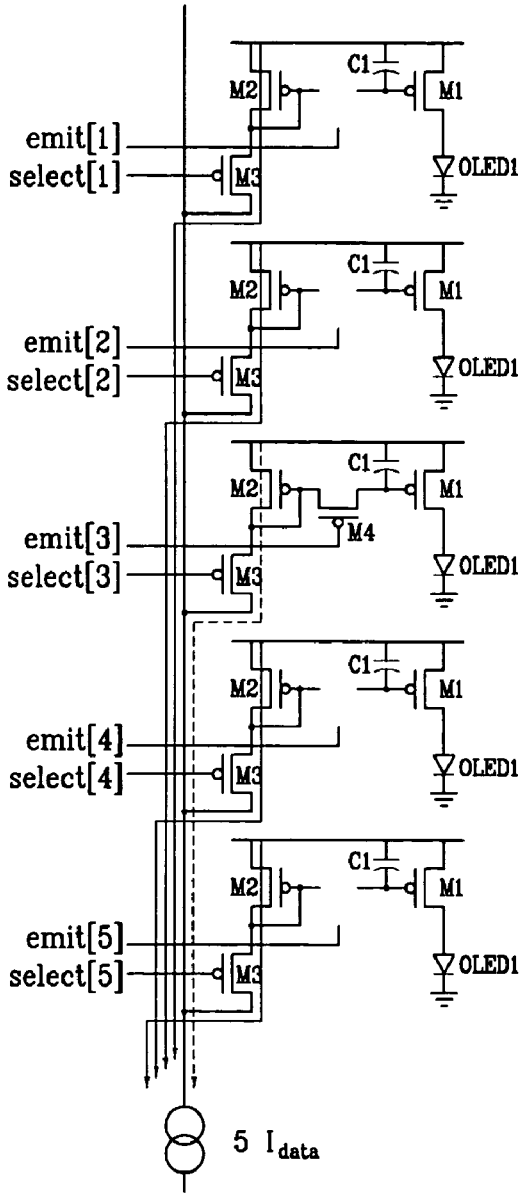
FIGS. 15A and 15B show circuit diagrams for describing an operation of the light emitting display device when the waveform of FIG. 14 is applied.
Figure 15B:
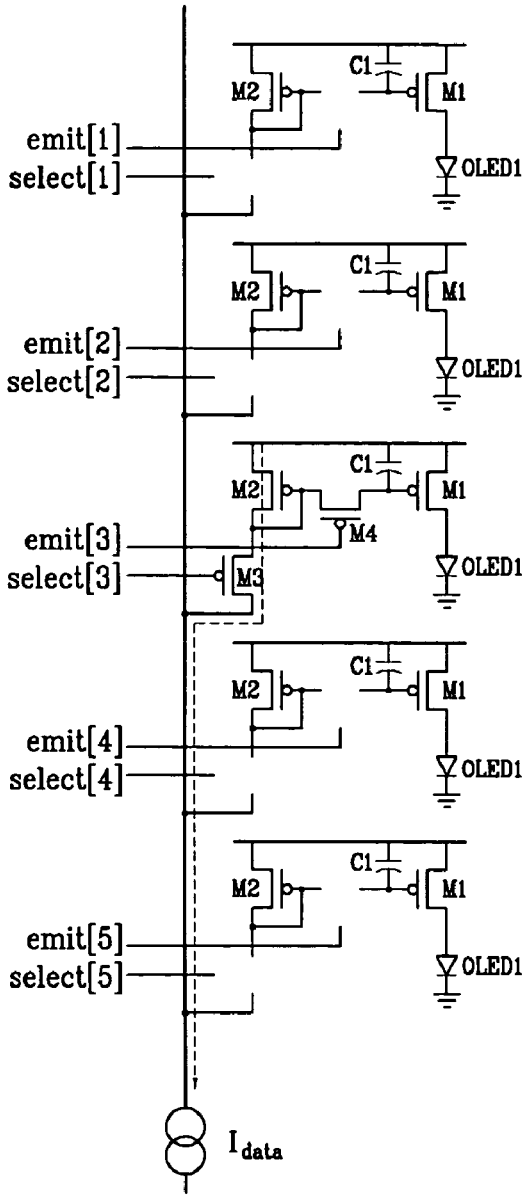

FIGS. 15A and 15B show circuit diagrams for describing an operation of the light emitting display device when the waveform of FIG. 14 is applied.

As shown in FIG. 15A, the pixels of the first, second, third, fourth and fifth rows are selected and the precharge current is supplied so that the current corresponding to current $I_{data}$ may be precharged in the data line, and as shown in FIGS. 14 and 15B, first and second scan signals select[3] and emit[3] are concurrently supplied to the pixel of the third row so that the data programming operation and the light emitting operation may be executed. In this instance, the pixel of the subsequent row can be precharged by turning off the transistor M4 of the third row to provide no influence to the voltage stored in capacitor C1, and allowing current $I_{data}$ provided from the data line to flow through transistors M3 and M2 of the third row. That is, the voltage which is nearer the voltage which corresponds to current $I_{data}$ is to be precharged to the data lines by allowing organic EL element OLED1 of the third row to emit light according to the voltage charged in capacitor C1, and allowing current $I_{data}$ provided from the data line to flow through transistors M3 and M2. Accordingly, for example, when first and second scan signals select[4] and emit[4] are supplied to the pixel of the subsequent row, that is, the fourth row, to thus perform the data programming operation and the light emitting operation, the data programming operation on the pixel of the fourth row can be more quickly performed according to the precharge voltage applied to the data lines.

Also, in order to reduce the data programming time on the pixel of the ith row in the precharge operation, the pixels of the i to i+(X−1)th rows are not precharged, but the pixels of the i to i−(X−1)th rows can be precharged as described in the third embodiment. That is, the data lines can be precharged by selecting the pixels which are adjacent in the other direction and consecutively provided with reference to the pixel of the ith row.

Figure 16:
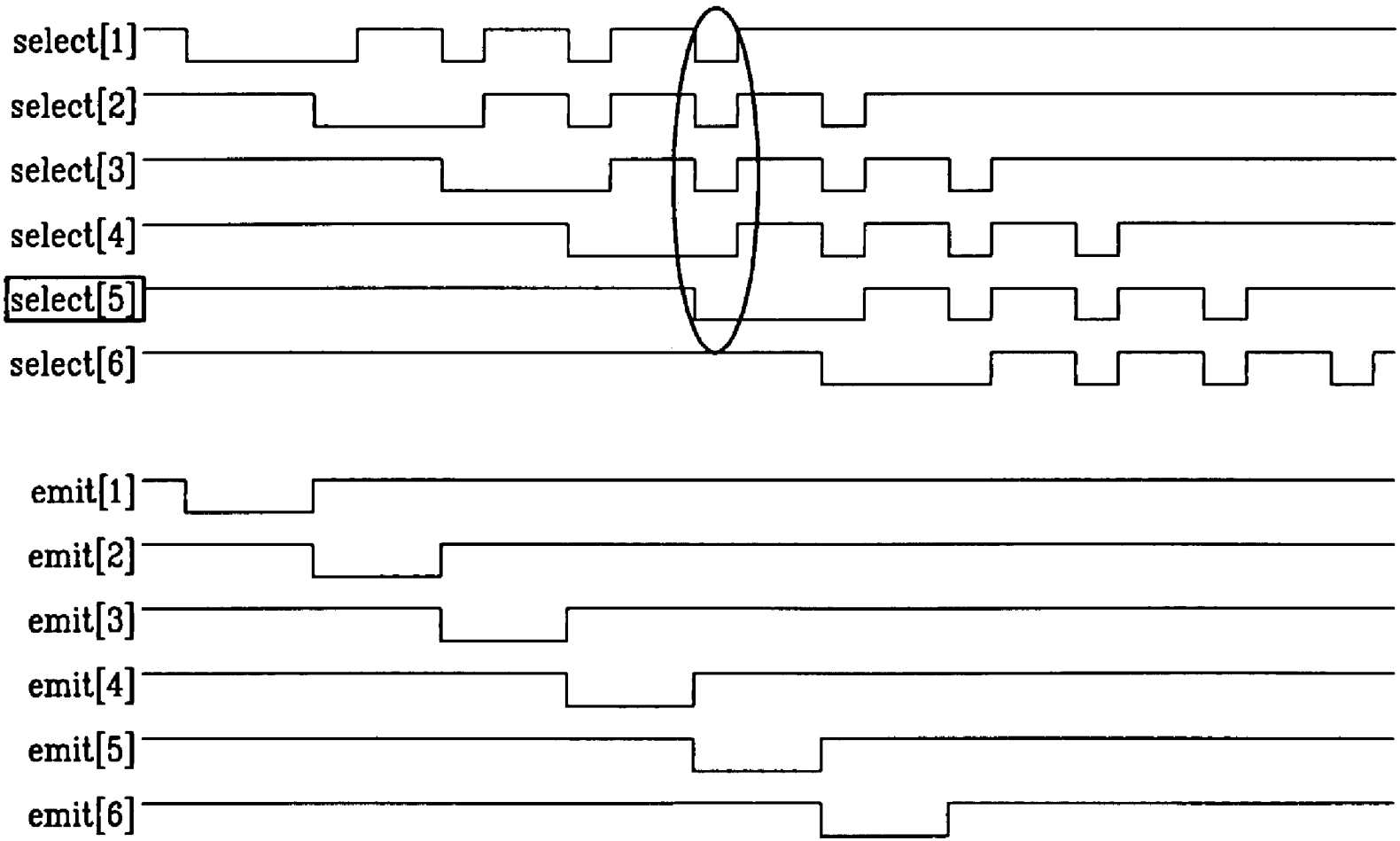
FIG. 16 shows another waveform diagram for driving a pixel circuit shown in FIG. 11.

FIG. 16 shows another waveform diagram for driving the pixel circuit of FIG. 11. In order to program the data on the pixel of the fifth row, the waveform of FIG. 16 selects the pixels of from the fourth to first rows with reference to the pixel of the fifth row, and precharges the data lines.

Figure 17A:
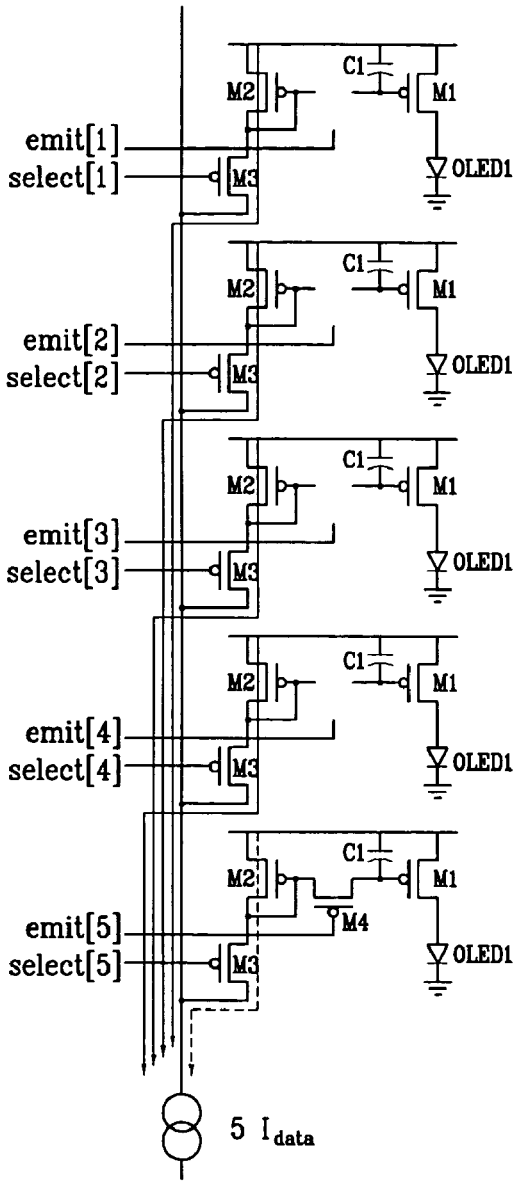
FIGS. 17A and 17B show circuit diagrams for describing an operation of the light emitting display device when the waveform of FIG. 16 is applied.
Figure 17B:
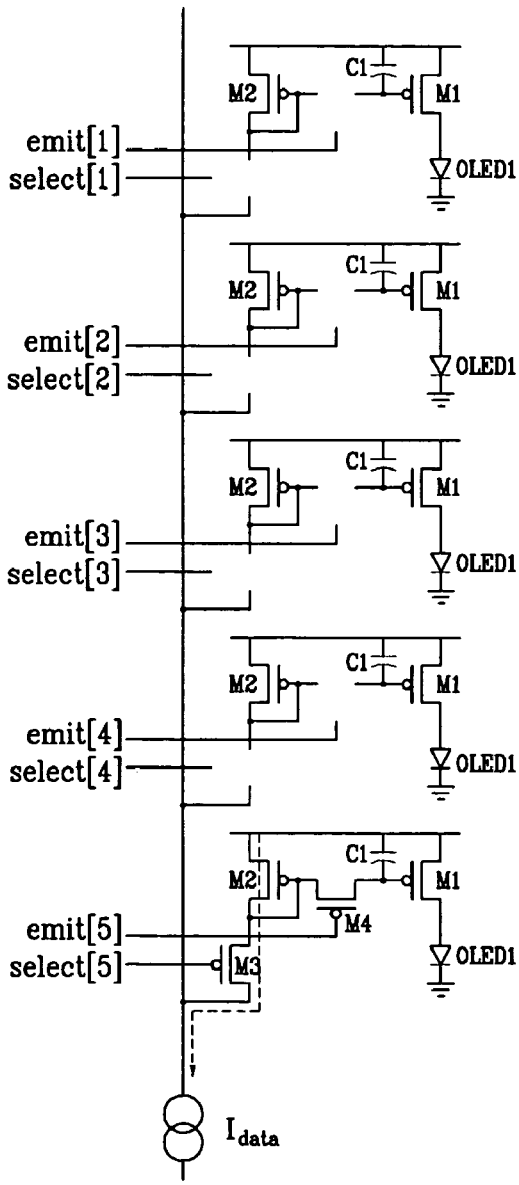

FIGS. 17A and 17B show circuit diagrams for describing an operation of the light emitting display device when the waveform of FIG. 16 is applied.

Similar to the third embodiment approach, the pixels of the first, second, third, fourth, and fifth rows are selected and the precharge current is supplied so that the current corresponding to the current of $I_{data}$ may be precharged in the data line as shown in FIG. 17A, and first and second scan signals select[5] and emit[5] are supplied to the pixel of the fifth row to perform the data programming operation and the light emitting operation as shown in FIGS. 16 and 17B.

In order to enhance the first exemplary embodiment, the data lines can be precharged by using the adjacent pixels of the rows adjacent to the pixel of the row on which the data will be programmed as described in the second and third embodiments, and differing from these, the data lines can be precharged by installing a precharge means in each pixel.

Figure 18:
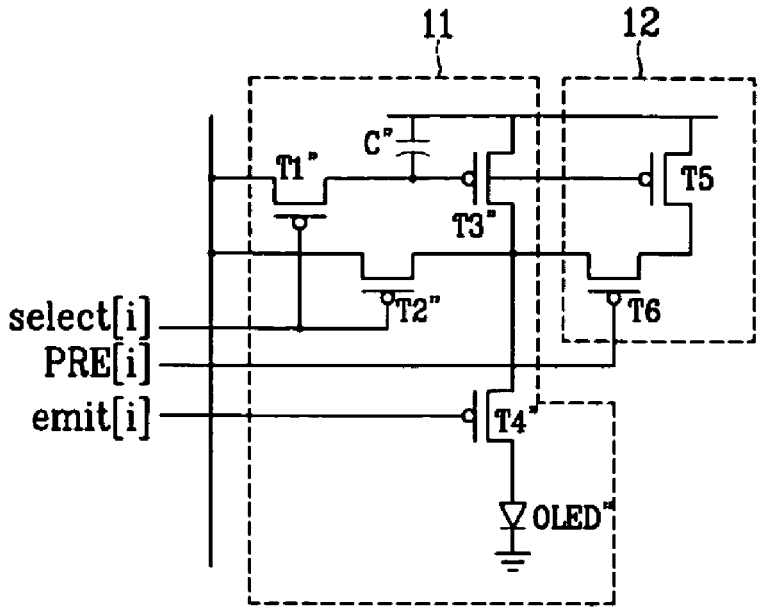
FIG. 18 shows a pixel circuit diagram of a light emitting display device according to a fourth exemplary embodiment of the present invention.

FIG. 18 shows a pixel circuit diagram of a light emitting display device according to a fourth exemplary embodiment of the present invention.

As shown, the pixel circuit of the light emitting display device is formed at a point where the data line, the first and second signal lines, and a precharge line cross. The pixel circuit includes pixel unit 11 which includes transistors T1", T2", T3", and T4", capacitor C", and organic EL element OLED". In addition, the pixel circuit includes precharger 12 which includes transistors T5 and T6. The ratio of W/L of transistor T5 of precharger 12 is X−1 times the ratio of W/L of transistor T3 of pixel unit 11.

An operation of the light emitting display device according to the fourth exemplary embodiment of the present invention will be described.

Since each pixel has a built-in precharger (e.g., precharger 11 of FIG. 18) in the fourth embodiment, the pixels on which the data will be written are driven to perform a precharge operation without driving the pixel of the row adjacent to the pixels on which the data will be written to perform the precharge operation.

Figure 19:
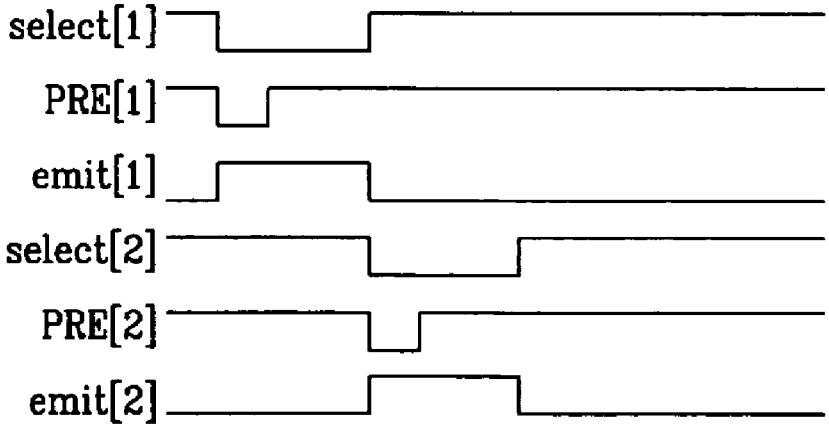
FIG. 19 shows a waveform diagram for driving a pixel circuit shown in FIG. 18.

FIG. 19 shows a waveform diagram for driving the pixel circuit shown in FIG. 18, and FIGS. 20A, 20B, and 20C show circuit diagrams for describing an operation of the light emitting display device when the waveform of FIG. 19 is applied.

Figure 20A:
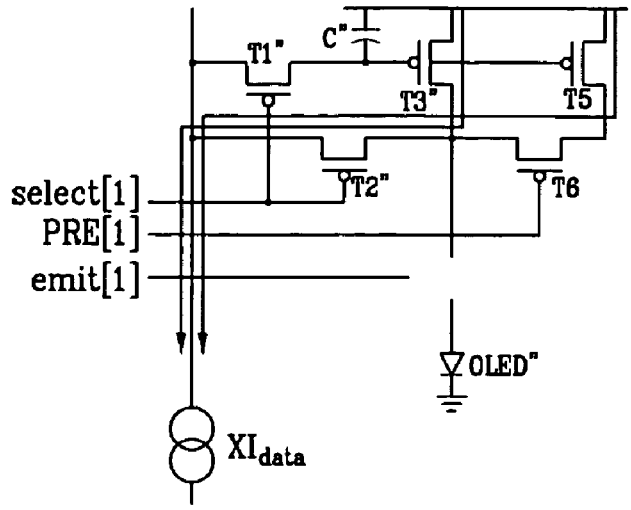
FIGS. 20A, 20B, and 20C show circuit diagrams for describing an operation of the light emitting display device when the waveform of FIG. 19 is applied.

First scan signal select[1] and precharge signal PRE[1] are supplied to the pixel of the ith row, and precharge current $XI_{data}$ is supplied to the data line in the precharge operation. Accordingly, transistor T2" of pixel unit 11 is turned on, and as shown in FIG. 20A, the transistor M6 of the precharger 12 is turned on so that precharge current $XI_{data}$ provided from the data line flows. In this instance, since the ratio W/L of transistor T5 of precharger 12 is X−1 times the ratio W/L of transistor T3" of pixel unit 11, the current of $(X-1)I_{data}$ flows to transistor T5, and current $I_{data}$ flows to transistor T3. Therefore, the voltage which corresponds to current $I_{data}$ is substantially applied to the data line.

Figure 20B:
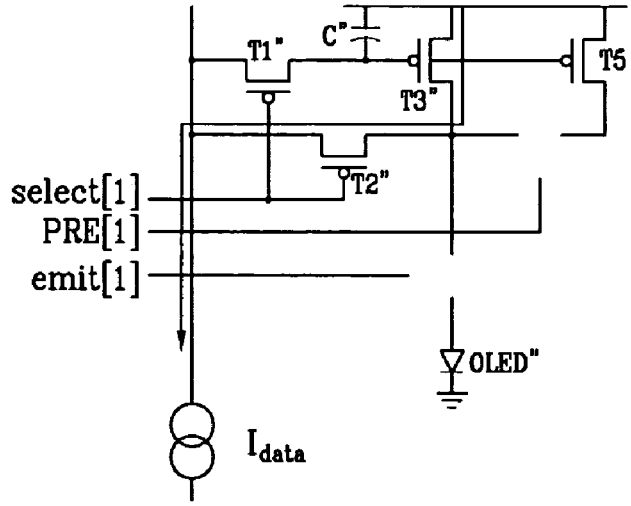

As shown in FIGS. 19 and 20B, when supply of precharge signal PRE[1] is interrupted, first scan signal select[1] is still supplied, and data current $I_{data}$ is supplied from the data line after the above-described precharge operation, the current flow to precharger 12 is prevented, and the voltage which corresponds to the data current $I_{data}$ provided from the data line is charged in capacitor C". In this instance, since the precharge voltage (the voltage which is near the voltage corresponding to the current of $I_{data}$) is applied to the data line according to the previous precharge operation, the voltage which corresponds to the data current $I_{data}$ is quickly charged in capacitor C".

Figure 20C:
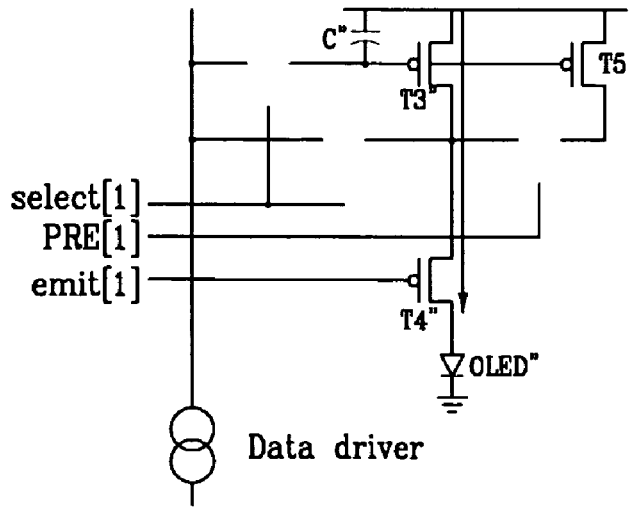

Referring now to FIGS. 19 and 20C, when the charging is finished, transistor T4" is turned on according to second scan signal emit[1] applied from the second signal line to supply data current of $I_{data}$ to organic EL element OLED" through transistor T4", and organic EL element OLED" emits light in correspondence to the current, in a like manner of the first exemplary embodiment.

In accordance with the fourth embodiment, the data lines can be precharged by combining the method for using the precharger in each pixel to precharge the data lines and the method for using the pixels on which the data will be programmed and the adjacent pixels as described in the third embodiment, from the above-described second to fourth exemplary embodiments.

In addition, to reduce the data programming time on the pixel of the ith row in the precharge operation in the second and third embodiments, the method for precharging the pixel of the i+(X−1)th rows or the pixel of the i−(X−1)th row in the case of precharging the pixels of the i to i+(X−1)th rows or precharging the pixel of the i to i−(X−1)th row can use an additional dummy line pixel to precharge the pixel. For example, when the i+(X−1)th row is the last row on the panel, X−1 dummy lines are formed near the row, and the pixel of the i+(X−1)th row can be precharged in a like manner of the above-described embodiments. Further, when the i−(X−1)th row is the first row on the panel, X−1 dummy lines are formed near the row, and the pixel of the i−(X−1)th row can be precharged in a like manner of the above-described embodiments.

Further, the pixels of the i to i+(X−1)th rows or the pixel of the i to i−(X−1)th rows can be respectively precharged by applying the above-described methods to other X−1 rows provided on the top of the panel except the i to i+(X−1)th rows or other X−1 rows provided on the bottom of the panel except the i to i−(X−1)th rows.

In the above-described exemplary embodiments, the precharge operation should be performed for a time which is greater than 1/X times the select time, that is, the select time t can be a time for programming the data on the pixel when precharging the data line is precharged with X times the data current.

Also, the data driver is described to supply the precharge current in the above embodiments, and a means for supplying the precharge current can be formed in addition to the data driver.

Further, the current precharging method according to the above-noted embodiments can be executed in the low grayscales below a predetermined value.

According to the present invention, the time for charging the data lines is effectively reduced.

In particular, the data programming is quickly performed by precharging the data line with a voltage which has a big difference from the voltage (the target voltage) corresponding to the current data, with a voltage which is near the target voltage by using a large current, the data line being caused by the data applied to the previous pixel line or caused by the precharge operation. Accordingly, accurate gray is represented.

While this invention has been described in connection with certain exemplary embodiments, it is to be understood that the invention is not limited to the disclosed embodiments, but, on the contrary, is intended to cover various modifications included within the spirit and scope of the appended claims and equivalents thereof. For example, the scope of the present invention cannot only be applied to the above-described specific pixels circuits, but can also be applied to the pixel circuits of other suitable current programming methods that consider data programming time as an important factor.

What is claimed is:

1. A light emitting display device comprising:

a data line formed in one direction and for applying a data current;

a first signal line and a second signal line for transmitting a first scan signal and a second scan signal respectively, the first signal line and the second signal line crossing the data line and a plurality of other data lines;

a plurality of pixel circuits formed at areas generated by crossing the first and second signal lines with the data line and the plurality of other data lines and for displaying images which correspond to the data current; and a data driver for supplying a precharge current to the data line according to a first control signal and for supplying the data current to the data line according to a second control signal.

2. The light emitting display device of claim 1, wherein the data current is to be supplied to a reference pixel circuit of the pixel circuits wherein a first pixel circuit of the pixel circuits near the reference pixel circuit of the pixel circuits is driven in addition to the reference pixel, and wherein the data line is precharged by the first pixel circuit and the reference pixel circuit when the precharge current is supplied.

3. The light emitting display device of claim 2, wherein the reference pixel circuit and the first pixel circuit, which is adjacent to a first direction of the reference pixel circuit and consecutively arranged with the reference pixel circuit, are driven when the precharge current is supplied.

4. The light emitting display device of claim 3, wherein the reference pixel circuit and a second pixel circuit, which is adjacent to a second direction of the reference pixel circuit and consecutively arranged with the reference pixel circuit, are driven when the precharge current is supplied.

5. The light emitting display device of claim 4, wherein the first direction and the second direction are opposite directions.

6. The light emitting display device of claim 2, wherein the precharge current is X times the data current, and X pixel circuits of the pixel circuits including the reference pixel circuit are driven to charge the precharge current in the data line when the precharge current is supplied.

7. The light emitting display device of claim 1, wherein when the precharge current is X times the data current, a time, T for supplying the precharge current satisfies: $T \geqq t/X$ where T is the time for supplying the precharge current, and t is a time for programming a data on the reference pixel circuit.

8. The light emitting display device of claim 1, wherein at least one of the pixel circuits comprises:

a first switch for applying the data current provided from the data line in response to the first scan signal provided from the first signal line;

a capacitor for charging a voltage corresponding to the data current provided from the first switch;

a light emitting element;

a first transistor for supplying a current corresponding to the voltage charged in the capacitor to the light emitting element; and a second switch for interrupting the current supplied from the first transistor to the light emitting element in response to the second scan signal provided from the second signal line.

9. The light emitting display device of claim 1, wherein at least one of the pixel circuits comprises:

a first transistor for forming a path for applying a current supplied through the data line;

a second transistor, operable by the first scan signal, for controlling current flow between the data line and the first transistor;

a capacitor for converting the current flowing through the path formed by the first transistor into a voltage;

a third transistor, operable by the second scan signal, for performing a switching operation between the first transistor and the capacitor;

a fourth transistor for forming a current mirror together with the first transistor and for supplying a current corresponding to the voltage at the capacitor; and a light emitting element for emitting light according to the magnitude of the current supplied by the fourth transistor and for performing a display operation.

10. The light emitting display device of claim 1, wherein at least one of the pixel circuits comprises:

a pixel unit for displaying images corresponding to the data current; and a precharger for charging a current supplied from the data driver in the data line into the precharge current.

11. A light emitting display device comprising:

a data line formed in one direction, and for applying a data current;

a first signal line and a second signal line for transmitting a first scan signal and a second scan signal respectively, the first signal line and the second signal line crossing the data line;

a plurality of pixel circuits including: a pixel unit formed at areas generated by crossing the first and second signal lines with the data line and for displaying images which correspond to the data current and a precharger for charging a current supplied from the data driver in the data line into a precharge current; and a data driver for supplying the precharge current to the data line according to a first control signal and for supplying the data current to the data line according to a second control signal, wherein the data current is to be supplied to a reference pixel circuit of the plurality of pixel circuits and wherein the data line is precharged by driving a set of the plurality of pixel circuits adjacent to a reference pixel circuit of the plurality of pixel circuits in addition to the reference pixel circuit when the precharge current is supplied to the data line.

12. The light emitting display device of claim 11, further comprising a third signal line for applying a precharge control signal to the precharger of the pixel circuit.

13. The light emitting display device of claim 12, wherein the precharger comprises:

a first switch for interrupting the precharge current provided from the data line in response to the precharge control signal; and a first transistor for supplying the current corresponding to the precharge current to the data line.

14. The light emitting display device of claim 13, wherein the pixel unit comprises:

a second switch for applying the data current provided from the data line in response to the first scan signal provided from the first signal line;

a capacitor for charging a voltage corresponding to the data current provided from the second switch;

a light emitting element;

a second transistor for supplying the current corresponding to the voltage charged in the capacitor to the light emitting element; and a third switch for interrupting a current provided from the second transistor to the light emitting element in response to the second scan signal provided from the second signal line.

15. The light emitting display device of claim 14, wherein the first transistor of the precharger has a ratio of a channel width divided by a channel length that is X−1 times a ratio of a channel width divided by a channel length of the second transistor of the pixel unit when the precharge current is X times the data current.

16. A method for driving a light emitting display device having pixel circuits arranged in a matrix format and formed at areas generated by crossing a data line and first and second signal lines, wherein at least one of the pixel circuits includes a capacitor, a transistor for supplying the current corresponding to a voltage charged in the capacitor, and a light emitting element, the method comprising:

(a) supplying a precharge current which is X times a data current to the data line to precharge the data line;

(b) charging a voltage which corresponds to the data current transmitted from the data line in the capacitor according to a first scan signal provided from the first signal line; and (c) allowing the light emitting element to emit light in response to the current which corresponds to the voltage charged in the capacitor applied from the transistor in response to a second scan signal applied through the second signal line, wherein (a) comprises driving a reference pixel circuit of the plurality of pixel circuits of a row to which the data current will be provided and a set of the plurality of pixel circuits adjacent to the reference pixel circuit and precharging the data line.

17. The method of claim 16, wherein (a) further comprises driving the reference pixel circuit and at least a first pixel circuit of the pixel circuits adjacent to a first direction of the reference pixel circuit and consecutively arranged with the reference pixel circuit and precharging the data line.

18. The method of claim 17, wherein (a) further comprises driving the reference pixel circuit and at least a second pixel circuit of the pixel circuits adjacent to a second direction of the reference pixel circuit and consecutively arranged with the reference pixel circuit and precharging the data line.

19. The method of claim 18, wherein the first direction and the second direction are opposite directions.

20. The method of claim 16, wherein the precharge current is X times the data current, and X pixel circuits of the pixel circuits including the reference pixel circuit are driven to precharge the data line when the precharge current is supplied.

* * * * *